US008264432B2

(12) United States Patent
Ishii et al.

(10) Patent No.: US 8,264,432 B2
(45) Date of Patent: Sep. 11, 2012

(54) DISPLAY DEVICE

(75) Inventors: Masato Ishii, Tokyo (JP); Naruhiko Kasai, Yokohama (JP); Tohru Kohno, Kokubunji (JP); Hajime Akimoto, Kokubunji (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 515 days.

(21) Appl. No.: 12/496,783

(22) Filed: Jul. 2, 2009

(65) Prior Publication Data

US 2010/0033410 A1 Feb. 11, 2010

(30) Foreign Application Priority Data

Aug. 8, 2008 (JP) ..... 2008-205049

(51) Int. Cl.
*G09G 3/30* (2006.01)

(52) U.S. Cl. ..... 345/77; 345/76; 345/98; 345/104

(58) Field of Classification Search ..... 345/76–83, 345/98–104
See application file for complete search history.

(56) References Cited

U.S. PATENT DOCUMENTS 6,496,168 B1 * 12/2002 Tomida ..... 345/76
2004/0080637 A1 * 4/2004 Nakamura et al. ..... 348/255
2006/0038501 A1 2/2006 Koyama et al.
2008/0203930 A1 * 8/2008 Budzelaar et al. ..... 315/169.1
2008/0291072 A1 * 11/2008 Sano ..... 341/158
2009/0027423 A1 * 1/2009 Kwon ..... 345/690
2009/0115795 A1 * 5/2009 Pae et al. ..... 345/589

FOREIGN PATENT DOCUMENTS

JP 2006-091709 4/2006
JP 2006-091860 4/2006

* cited by examiner

*Primary Examiner* — Amare Mengistu
*Assistant Examiner* — Premal Patel
(74) *Attorney, Agent, or Firm* — Antonelli, Terry, Stout & Kraus, LLP.

(57) ABSTRACT

An image display device comprises a unit which divides one line into a plurality of blocks (blocks A, B, and C) in a horizontal direction and detects in parallel, a unit which collectively detects a plurality of lines (lines A and B) in a vertical direction in parallel. The unit detects a pixel state of a pixel of the block (for example, block A) and a pixel state of the same pixel as an adjacent block (for example, block B), and corrects a variation between the detection result of the block and the detection result of the adjacent block. The unit detects a pixel state of a pixel through the line (for example, line A) and a pixel state of the same pixel through a different line (for example, line B), and corrects a variation between the detection result of the line and the detection result of the different line.

3 Claims, 19 Drawing Sheets

DISPLAY DEVICE

CROSS-REFERENCE TO RELATED APPLICATION

The present application claims priority from Japanese application JP 2008-205049 filed on Aug. 8, 2008, the content of which is hereby incorporated by reference into this application.

BACKGROUND OF THE INVENTION

1. Field of the Invention

The present invention relates to a display device in which brightness can be controlled corresponding to an amount of current applied to a display element or light emission time, and, in particular, to a display device having a self-emissive element as a display element such as an organic EL (electro luminescence) element or an organic light emitting diode (OLED).

2. Description of the Related Art

With spreading of various information processing devices, various types of display devices having various functions have been introduced. Of these various types of display devices, self-emissive display devices have attracted attention, and, in particular, organic EL displays have attracted much attention. Because a light emitting element used in this device such as an OLED is a self-emissive element, such an element does not require a backlight and is suited for low power consumption. In addition, the element has an advantage such as that the visibility of the pixel is higher compared to the liquid crystal display in the related art and that the response speed is faster. Moreover, the light emitting element has a diode-like characteristic, and the brightness can be controlled based on an amount of current applied to the element. A driving method in such a self-emissive display device is disclosed in, for example, JP 2006-91709 A. In addition, JP 2006-91860 A or the like discloses a structure in which a current is set with a monitor element and a voltage is supplied to each pixel.

SUMMARY OF THE INVENTION

A light emitting element has a characteristic in which an internal resistance value of the element changes by the used period and peripheral environment. In particular, the element has a characteristic that, when the used period is increased, the internal resistance is increased as time elapses, and the current flowing through the element is reduced. Because of this, if a pixel of a same location in a screen is switched ON such as a menu display, the location in the screen may be burnt. In order to correct this state, a state of the pixel must be detected. As the detection method, a method of detecting during a blanking period of the display is employed. During the blanking period, no voltage is applied to the pixel because no light is to be emitted. Therefore, a method is employed in which a power supply which differs from the power supply used for light emission is used, a certain current is applied to the pixel during the blanking period, and a voltage is detected in this state, to detect degradation due to the persisting image based on the change of the voltage. Because of this, during the display period, no current can be applied to the pixel, and, thus, the circuit used for the detection is only used during the blanking period. However, in this method, the amount of current to be applied to the pixel is limited. Because the light emission brightness and the amount of current of the pixel are proportional, if the amount of current is large, the light emission of the pixel during the detection period becomes apparent, and, thus, the contrast is reduced. In consideration of the detection time, however, because various capacitances in the detection system and the internal resistance of the OLED are high, if the amount of current is small, the detection time is elongated. Because of these restrictions, the detection time during the blanking period cannot be easily shortened.

An advantage of the present invention is that the number of pixels detected at one time can be increased, the pixel state can be detected with a parallel process, and the detection time can be shortened.

The detection system is divided into a plurality of groups (divided into a plurality in horizontal or vertical direction), and the detection process is applied in parallel. In the horizontal direction, the detection system is divided in units of blocks and, in the vertical direction, a plurality of lines are collectively considered. In each detection, a relative detection is employed in which a difference between adjacent pixels is considered, and correction is applied between blocks and between lines, to compensate for the continuity between divided portions.

According to one aspect of the present invention, there is provided an image display device having a display section comprising a plurality of pixels, a line for allowing input of a display signal to the pixel, and a line for allowing output of a pixel state of the pixel, the image display device comprising a parallel detection unit which divides the plurality of pixels in the display section into a plurality of groups and detects pixel states in parallel. According to another aspect of the present invention, it is preferable that the image display device further comprises a unit which detects, for at least one pixel in each group, a pixel state as the group and a pixel state as a group different from the group and which corrects variation between a detection result of the group and a detection result of the group different from the group based on the two detection results for the pixel.

According to various aspects of the present invention, by detecting the pixel state in parallel, it is possible to shorten the detection time. In addition, by correcting the detection result, the continuity between blocks can be maintained.

With various aspects of the present invention, the pixel state can be detected in a parallel process and the detection time can be shortened. For example, the time can be shortened corresponding to the number of divisions in the horizontal direction and/or the number of collections in the vertical direction.

DETAILED DESCRIPTION OF THE INVENTION

Preferred embodiments of the display device of the present invention will now be described in detail with reference to the drawings.

A display device of the preferred embodiments of the present invention comprises a unit which detects pixel states of a plurality of pixels in a parallel manner by dividing the pixels into a plurality of groups (divided in a plurality in horizontal direction and/or vertical direction). In addition, the display device comprises a unit which detects, for at least one pixel in each group, a pixel state in the group and a pixel state as another group different from the group, and corrects a variation between the detection result of the group and the detection result of the another group based on the two detection results of the pixel.

A first preferred embodiment of the present invention described below has a structure in which the pixel states are detected with the pixels divided in the horizontal direction. A second preferred embodiment described below has a structure in which the circuit size is reduced from the circuit size of the first preferred embodiment. A third preferred embodiment described below has a structure in which the pixel states are detected with the pixels collected in the vertical direction. A fourth preferred embodiment described below has a structure divided in the horizontal direction and collected in the vertical direction.

[First Preferred Embodiment]

Figure 1:
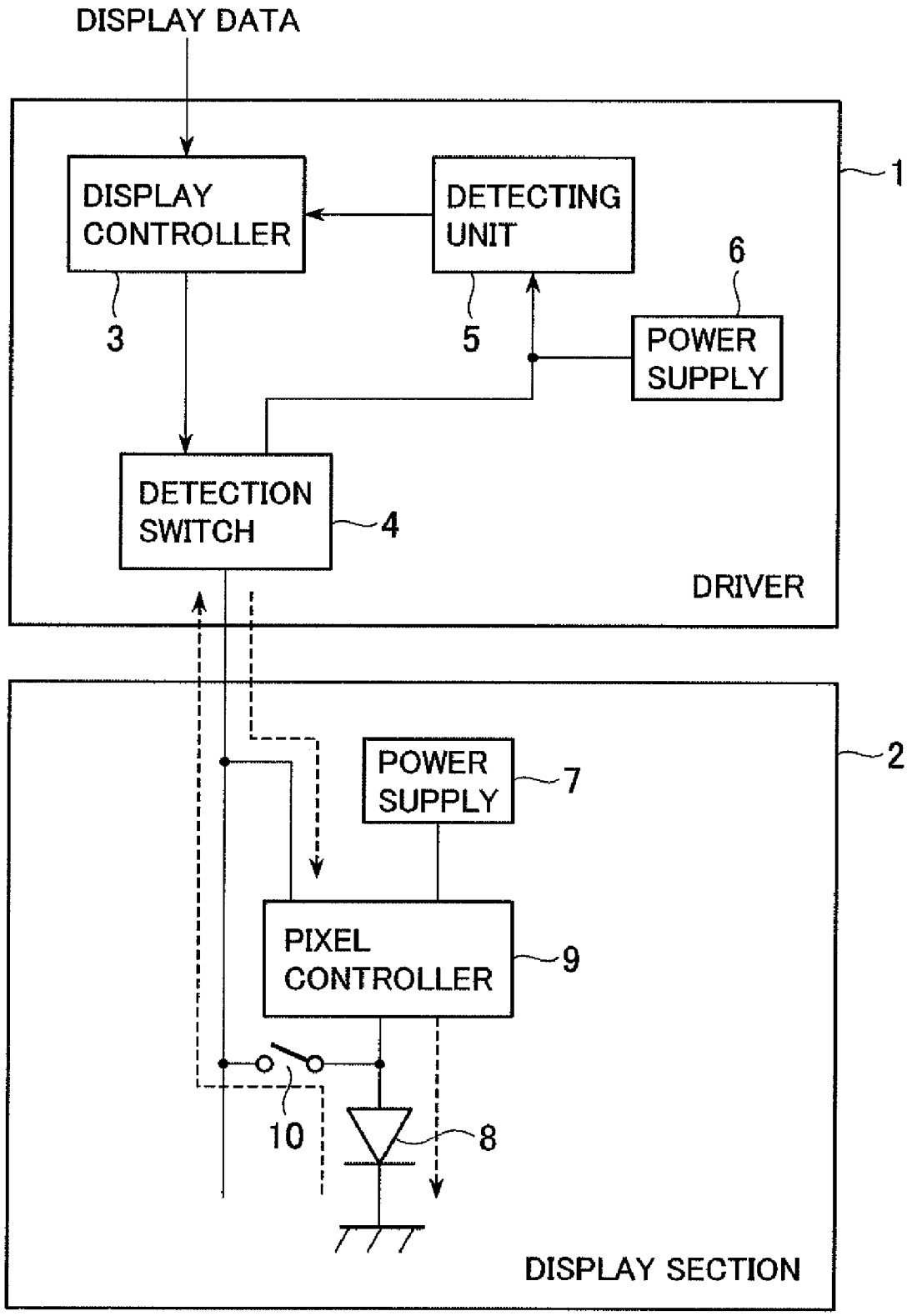
FIG. 1 is an overall structural diagram.

FIG. 1 is an overall structural diagram of a display panel section. A display panel section comprises a driver 1 and a display section 2. The driver 1 comprises a display controller 3, a detection switch 4, a detecting unit 5, and a detection power supply 6. The display section 2 comprises a display power supply 7, a display element 8, a pixel controller 9, and a switch 10. In FIG. 1, display data from the outside is input to the display controller 3 of the driver 1. The display controller 3 applies a timing control and signal control of the input display data. The signals can flow in the driver 1 largely in 3 paths, including a display path, a detection path, and a correction path. The display path is a flow in which the input display data enters the display section 2 through the display controller 3 and the detection switch 4 in the driver 1, and passes through the pixel controller 9 in the display section 2, and in which the display element 8 is driven with the display power supply 7. The detection path is a flow from the display element 8 in the display section 2 through the switch 10, and through the detection switch 4 in the driver 1 to the detecting unit 5. The correction path is a flow from the detecting unit 5 in the driver 1 to the display controller 3, and in which the input display data is corrected. The detection switch 4 is a switch for switching the data direction depending on whether it is the display period or the detection period. During the display period, the display power supply 7 is used as the power supply of the display section 2. During the detection period, the detection power supply 6 is used as the power supply of the display section 2. In the present embodiment, the number of power supplies is 2, but the number of power supplies may be increased or decreased depending on the structure, and, the type of the power supply may be changed between a current source and a voltage source depending on the structure. The pixel controller 9 controls the display power supply 7 with the display data during the display period and transmits the state of the display element 8 to the detecting unit 5 using the detection power supply 6 during detection period. In the present embodiment, as shown in FIG. 1, a line for inputting a display signal to a pixel (line from the display controller 3 to the pixel controller 9) and a line for outputting a pixel state of the pixel (line from the display element 8 to the detecting unit 5) are partially common, but the present invention is not limited to such a configuration, and the line for inputting the display signal to the pixel and the line for outputting the pixel state of the pixel may be separated provided.

Figure 2:
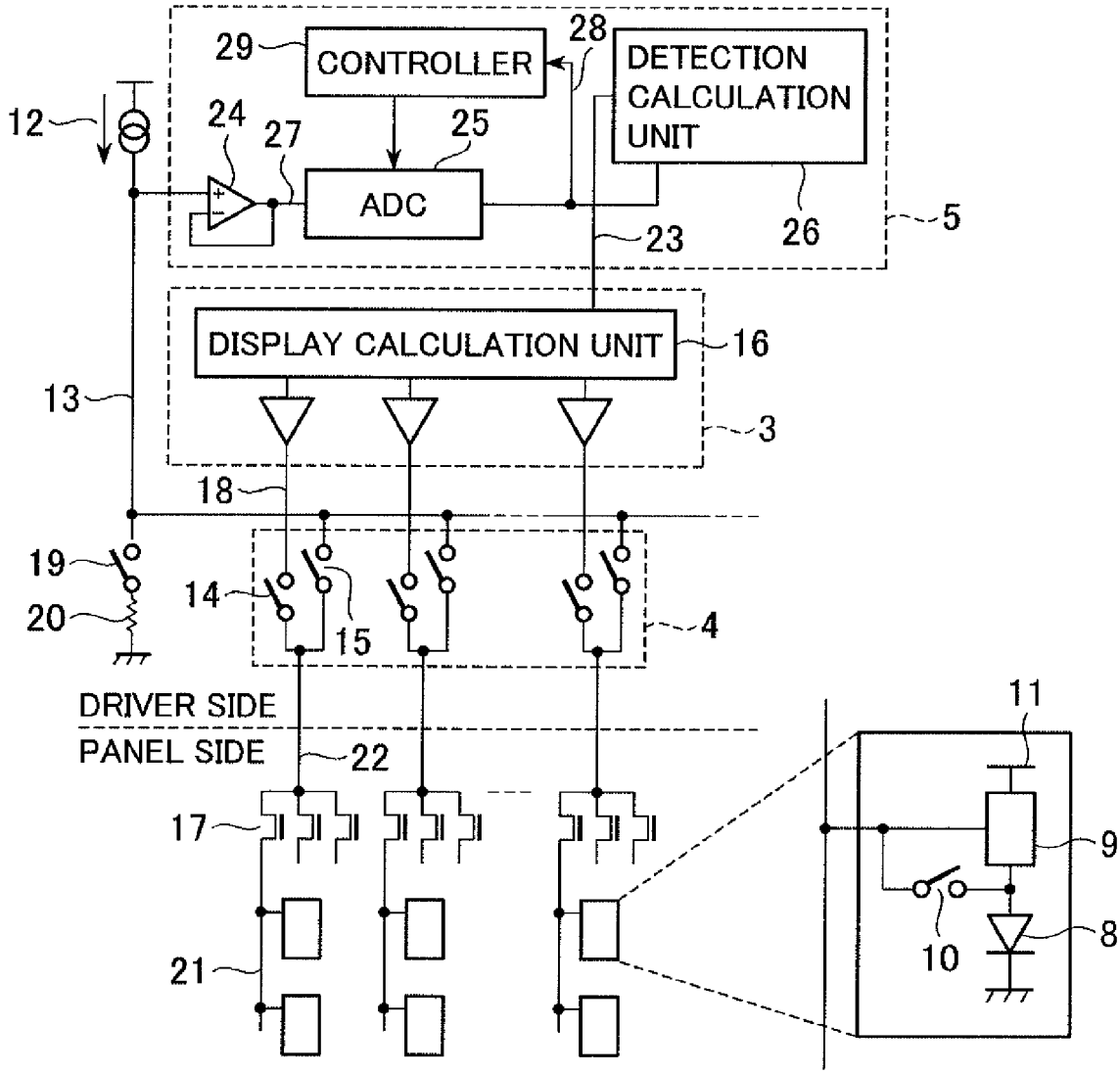
FIG. 2 is a detection structure diagram.

FIG. 2 is a diagram showing an example of an overall structural diagram of FIG. 1. While the present invention relates to a display device, here, an organic display device is exemplified as an example of the display device. A drive power supply of the display element 8 has a form independent during the detection period and during display period. During detection period, a detection current source 12 is used as the detection power supply 6 and, during display period, a display voltage source 11 is used as the display power supply 7. The display voltage source 11 is preferably common to display elements which contribute to display. A switch 14 is connected to a display calculation unit 16 with a signal line 18 and is switched ON during the display period. The detection current source 12 is connected to a switch 15 with a detection line 13. The switches 14 and 15 are not simultaneously switched ON. The display calculation unit 16 applies control of the switches and the power supplies, detection, and correction. During the display period, the switch 15 is in the OFF state, that is, the switch 15 is in an open state, and, thus, there is no load to the current from the current source 12. Therefore, during display period, it is preferable to stop the current source or connect another load. In the present embodiment, a dummy load is used during display period. A switch 19 is a switch which is switched ON during the display period and allows flow of a current of the current source to a resistor 20 which is a dummy resistor. With such a structure, the current flows to the resistor 20 during the display period and the current flows to the pixel during the detection period. A switch 17 is a switching switch of RGB existing inside the panel and is connected to each pixel with a signal line 21 and to the driver side with a signal line 22. A detection result of the pixel state is obtained at the detecting unit 5 through the detection line 13. The detecting unit 5 comprises a buffer 24, an A/D converter 25, a detection calculation unit 26, and an A/D conversion controller 29. The buffer 24 amplifies a value of the detection line 13 and outputs to a signal line 27. The A/D converter 25 converts an analog value of the signal 27 into a digital value of a signal 28. The detection calculation unit 26 calculates an amount of correction based on the digital value of signal 28 and outputs to a display calculation unit with a signal 23. The A/D conversion controller 29 controls the A/D converter based on the value of the signal 28. The detection calculation unit 26 may comprise a setting register or a setting memory, and the detection method and various settings can be changed based on the setting values.

Figure 3:
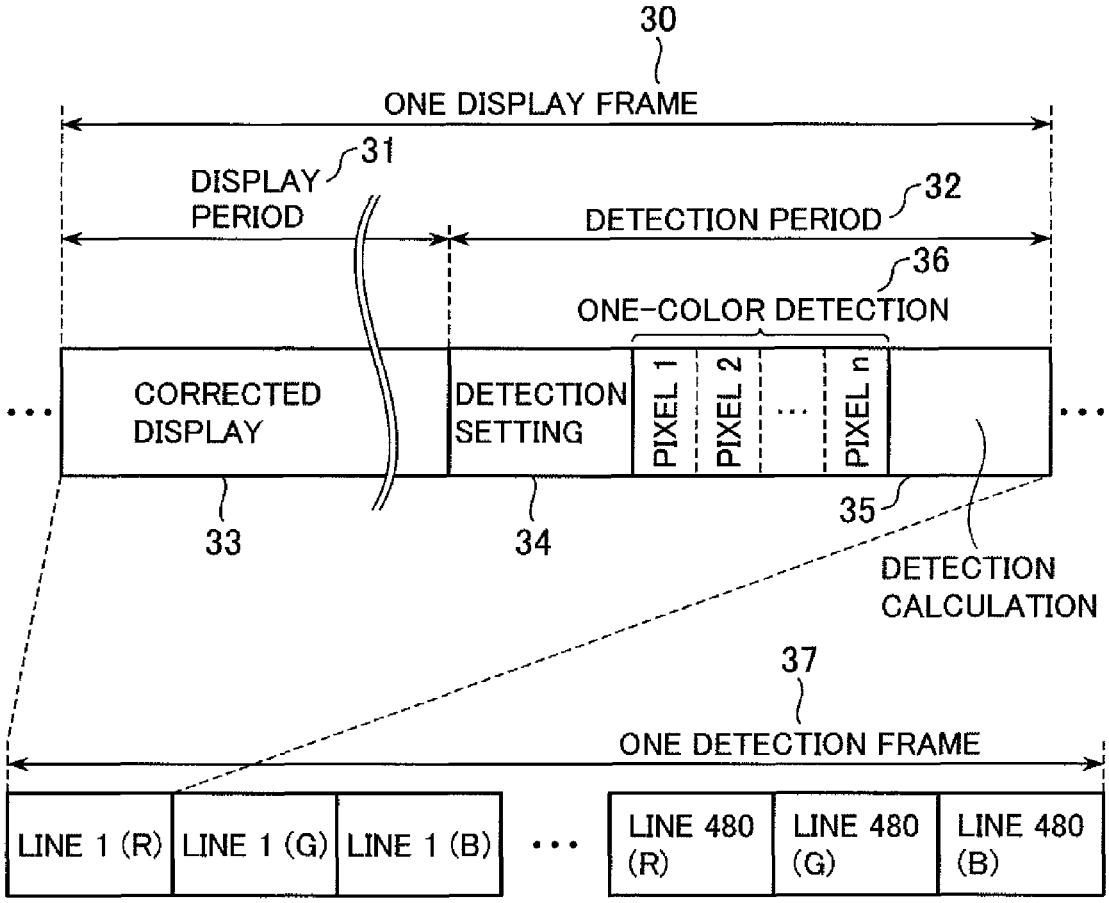
FIG. 3 is a diagram showing a timing of a system operation.

FIG. 3 shows timings of display and detection. In the present embodiment, one line of detection is applied for one frame of display. Normally, one frame comprises a display period and a blanking period. The blanking period is assigned as the detection period, and, thus, one display frame 30 comprises a display period 31 and a detection period 32. In the display period 31, a corrected display 33 is realized based on a correction value obtained based on the detection result. The detection period 32 comprises periods including a detection setting 34, a detection calculation 35, and a one-color detection 36. During the period of the detection setting 34, settings for the A/D converter 25 and the current source 12 are applied. During the period of the detection calculation 35, the detection calculation unit 26 calculates a correction value based on the detection result. During the period of the one-color detection 36, detection for number of pixels corresponding to one line is executed. One detection frame 37 shows a period for detecting all lines. In the present embodiment, detection of one line of one color during one display frame period is shown. Alternatively, it is also possible to execute detection of a plurality of lines or a plurality of colors during one display frame period.

Figure 4:
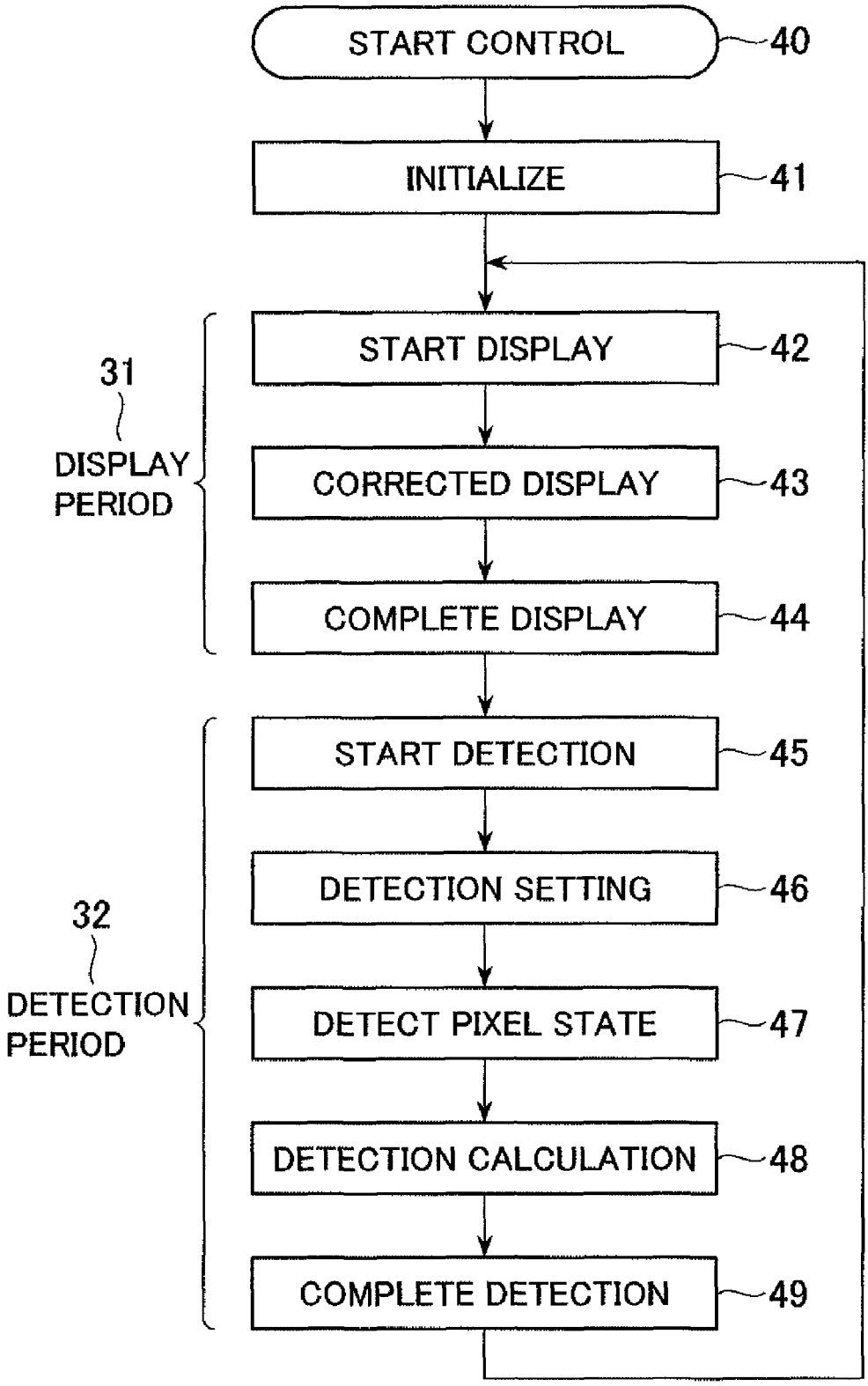
FIG. 4 is a diagram showing a flowchart of a system operation.

FIG. 4 is a control flowchart of the overall system. When the system process is started in process 40, the system is initialized in process 41. Then, the process transitions to the display period, a display process is started in process 42, and the display data is corrected and displayed in process 43. The display period 31 is completed in process 44. The process transitions to the detection period. The detection process is started in process 45, and detection setting is executed in process 46. The pixel state is detected in process 47, the correction value is calculated based on the detection result in process 48, and the detection period 32 is completed in process 49. During system operation, the display period and the detection period are repeated.

Figure 5:
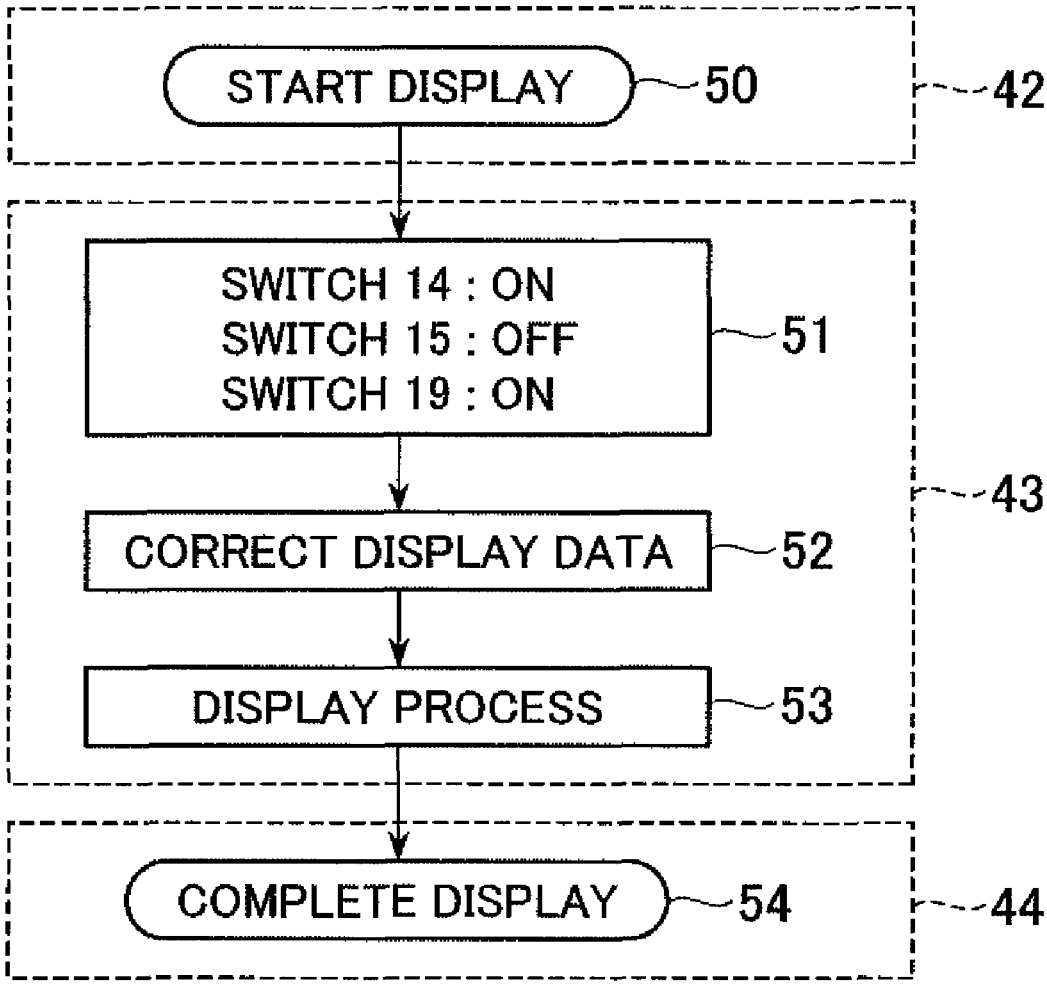
FIG. 5 is a diagram showing a flowchart of a display period.

FIG. 5 is a control flowchart of the display period. When the display process starts in process 50, the switch 14 is switched ON, the switch 15 is switched OFF, and the switch 19 is switched ON in process 51. The display data is corrected with the correction data in process 52 and displayed in process 53. From this state, an result of the calculation in the display calculation unit is outputted to each pixel. In addition, the output from the current source 12 is connected to the resistor 20. The display process is completed in process 54.

Figure 6:
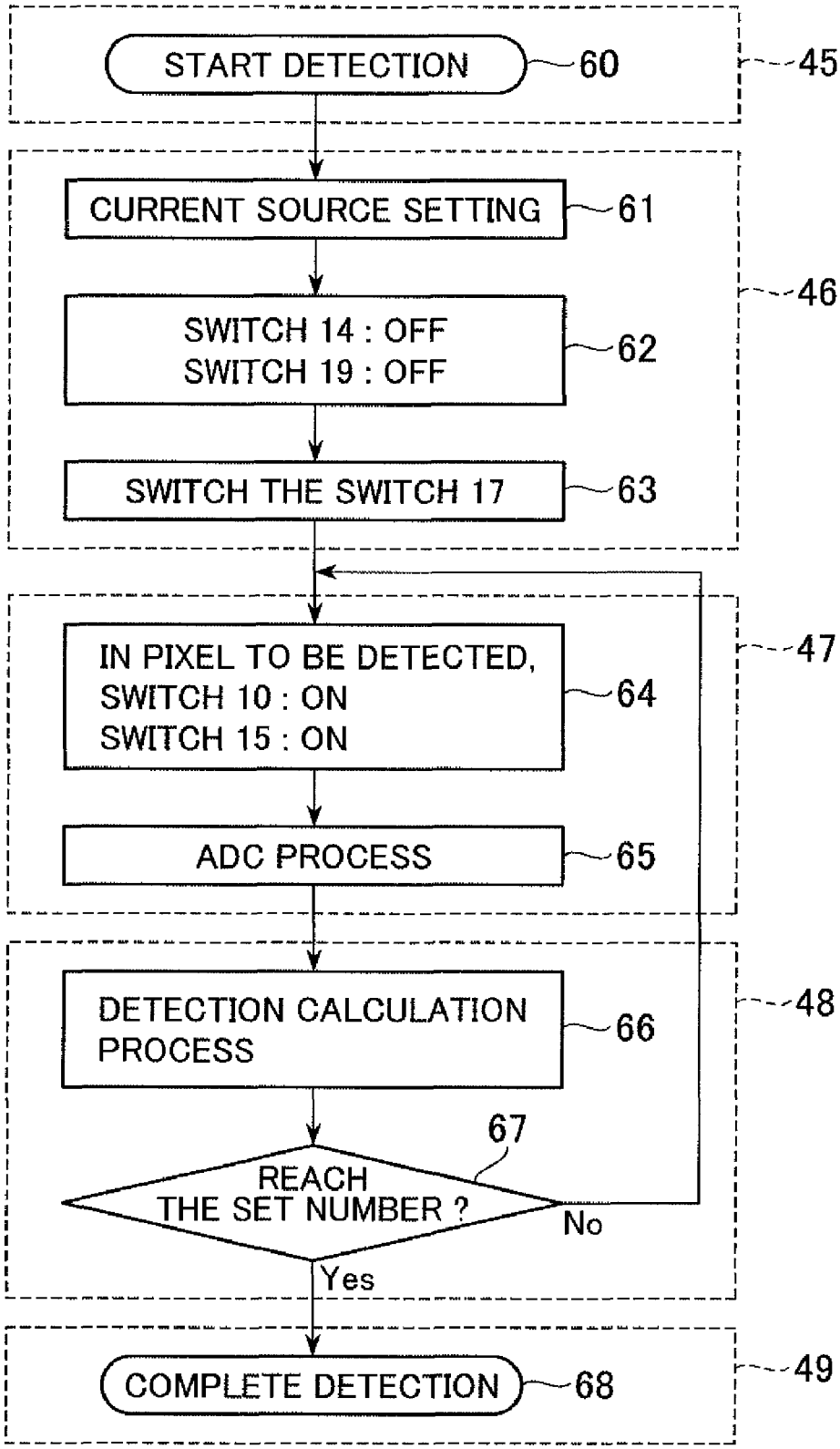
FIG. 6 is a diagram showing a flowchart of a detection period.

FIG. 6 is a control flowchart of detection period. When the detection process starts in process 60, the current source is set in process 61, the switch 14 is switched OFF and the switch 19 is switched OFF in process 62, and the switch 17 is switched corresponding to the detection pixel in process 63. The switch 10 corresponding to the path to be detected is switched ON and the switch 15 is switched ON in process 64. With this process, the pixel to be detected is connected to the detection line 13, and an A/D conversion process is applied in process 65. The detection calculation process is executed in process 66, to calculate the correction data. In process 67, it is judged whether or not a detection number of one time is reached. When the number is not reached, the process transitions to process 64 and the detection operation is repeated. If it is judged in process 67 that the number of detection of one time is reached, the detection process is completed in process 68.

Figure 7:
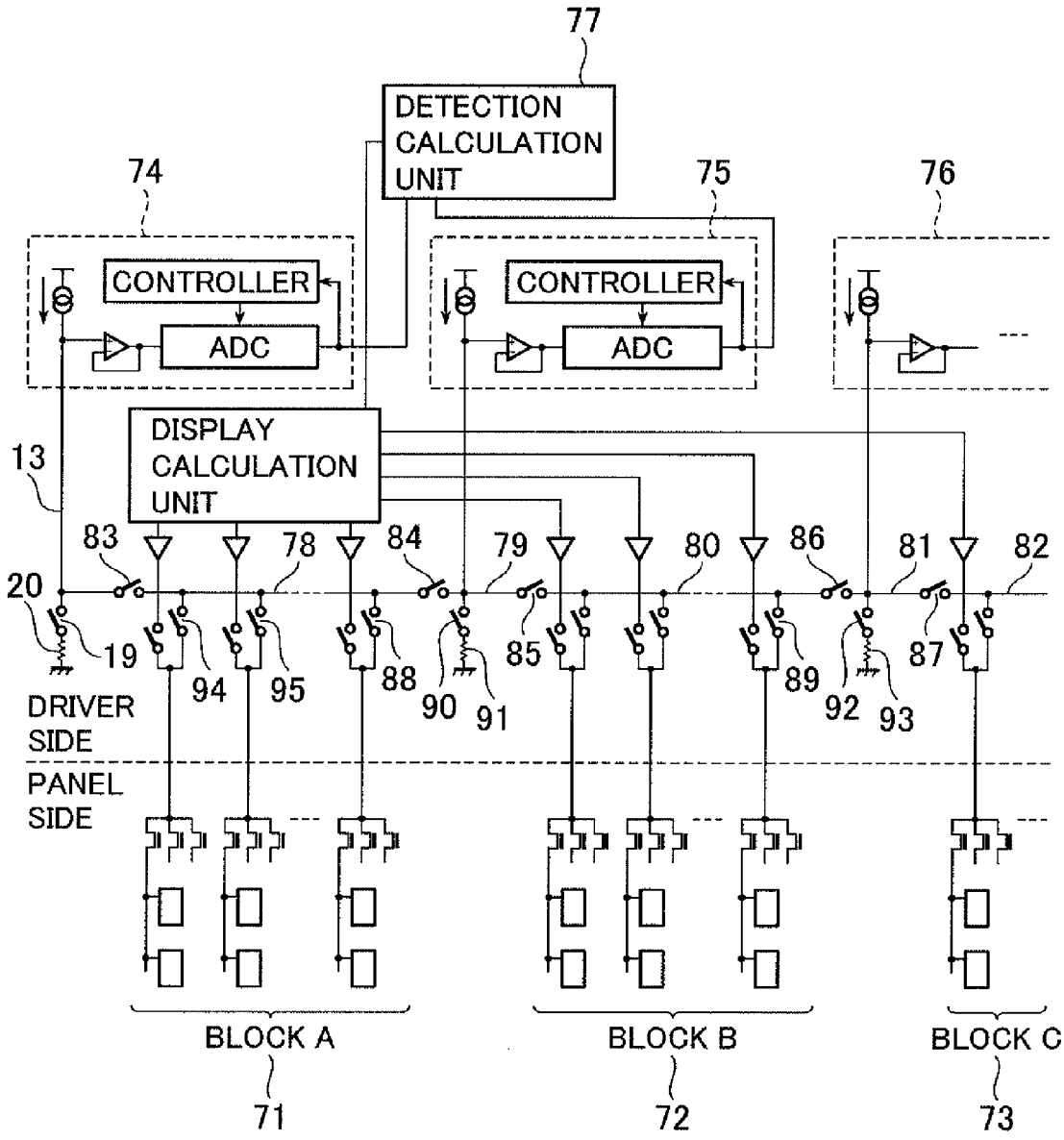
FIG. 7 is a diagram showing a structure of a first preferred embodiment of the present invention.

FIG. 7 shows an example of a detection method in which the detection is divided in horizontal direction and the detection is executed in parallel. Here, the unit of division in the horizontal direction is called a block. In the present embodiment, a configuration is shown where the horizontal direction is divided into a block A 71, a block B 72, and a block C 73. Each block independently comprises a conversion unit having a current source and an A/D converter. The conversion unit of the block A 71 is a conversion unit 74, the conversion unit of the block B 72 is a conversion unit 75, and the conversion unit of the block C 73 is a conversion unit 76. A detection calculation unit 77 collectively controls the outputs from the conversion units. The detection calculation unit is provided not for each block, but rather, one for all blocks. Each block has a structure in which the current source is completely separated with a switch. A detection line in the block A 71 is a detection line 78, a detection line in the block B 72 is a detection line 80, and a detection line in the block C 73 is a detection line 82. A line connecting the block A 71 and the block B 72 is a detection line 79, and a line connecting the block B 72 and the block C 73 is a detection line 81. The detection line 13 and the detection line 78 are connected by a switch 83, the detection line 78 and the detection line 79 are connected by a switch 84, the detection line 79 and the detection line 80 are connected by a switch 85, the detection line 80 and the detection line 81 are connected by a switch 86, and the detection line 81 and the detection line 82 are connected by a switch 87. A last group of pixels of the block A 71 and the detection line 78 are connected by a switch 88, and a last group of pixels of the block B 72 and the detection line 80 are connected by a switch 89. A resistor 20 in the block A 71 is connected to the detection line 13 by a switch 19. A resistor 91 in the block B 72 is connected to the detection line 79 by a switch 90. A resister 93 in the block C 73 is connected to the detection line 81 by a switch 92. A first group of pixels of the block A 71 is connected to the detection line 78 by a switch 94, and a second group of pixels of the block A 71 is connected to the detection line 78 by a switch 95. Although the detection time can be shortened by increasing the number of divisions, the circuit size is also enlarged, and, thus, the suitable number depends on the system.

Figure 8:
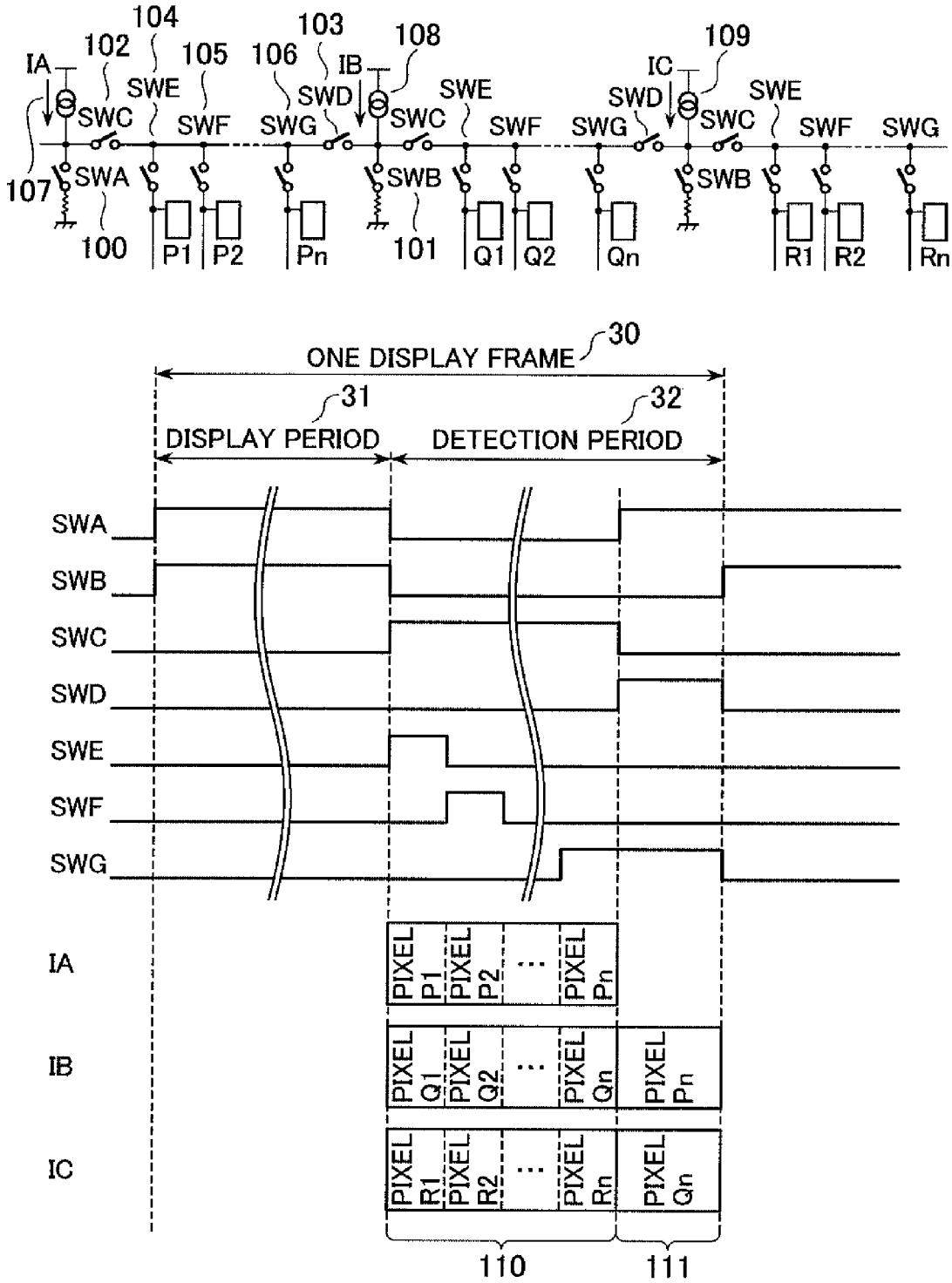
FIG. 8 is a diagram showing a timing in a first preferred embodiment of the present invention.

FIG. 8 is a diagram showing in a simplified manner a detection switch portion of the structure of FIG. 7. In FIG. 8, reference signs SWA, SWB, SWC, SWD, SWE, SWF, and SWG represent timings of the switches. As the timings of the switches on the detection lines, the timing of the switch 19 is set as SWA 100, the timings of the switches 90 and 92 are set as SWB 101, the timings of the switches 83, 85, and 87 are set as SWC 102, and the timing of the switches 84 and 86 are set as SWD 103. As the timings of the switches for pixel control, the timing of a control switch of a first pixel of each block, for example, the switch 94, is set as SWE 104, the timing of a control switch of a second pixel of each block, for example, the switch 95, is set as SWF 105, and the timing of the control switch of the last pixel of each block, for example, the switch 88, is set as SWG 106. A current of the current source is IA 107 for the block A, IB 108 for the block B, and IC 109 for the block C. The timing in one display frame is the ON state for SWA 100 and SWB 101 and OFF state for other switches during the display period. During the detection period, the timing is divided into the detection setting, detection, and detection calculation, but in FIG. 8, the detection setting and detection calculation are omitted and only the timing of the detection is shown. The timing of detection comprises a detection period 110 of each pixel and a detection period 111 for correcting current source setting. During the detection period 110, the pixels of the blocks, that is, a pixel P1 of the block A, a pixel Q1 of the block B, and a pixel R1 of the block C, are simultaneously detected in parallel, and the detection is executed until the last pixel of the block in a similar manner. During the detection period 111, in order to correct the detection result of current source between a certain block and an adjacent block, detection is executed with both current sources for the same pixel, and the detection value based on a second current source is corrected based on a reference at the detection value based on a first current source. With this process, the influence of division into block is suppressed and continuity of one line is maintained. During the detection period 110, while the SWA 100, SWB 101, and SWD 103 are at the OFF state and the SWC 102 is at the ON state, the SWE 104, SWF 105, and SWG 106 are switched ON and OFF corresponding to the detection pixel. During this period, IA 107 from the current source is used in the block A, IB 108 from the current source is used in the block B, and IC 109 from the current source is used in the block C. During the detection period 111, while the SWA 100 and the SWD 103 are at the ON state and the SWB 101 and the SWC 102 are at the OFF state, the SWE 104 and the SWF 105 are set at the OFF state and the SWG 106 is set at the ON state. During this period, IB 108 from the current source is used in the block A, IC 109 from the current source is used in the block B, and pixels Pn and Qn which are the last pixels of the blocks are detected. Here, other methods may be employed as the correction method of the current source. Based on the detection values of the pixel detected in the detection period 110 and the detection period 111, correction data of one line is calculated.

Figure 9:
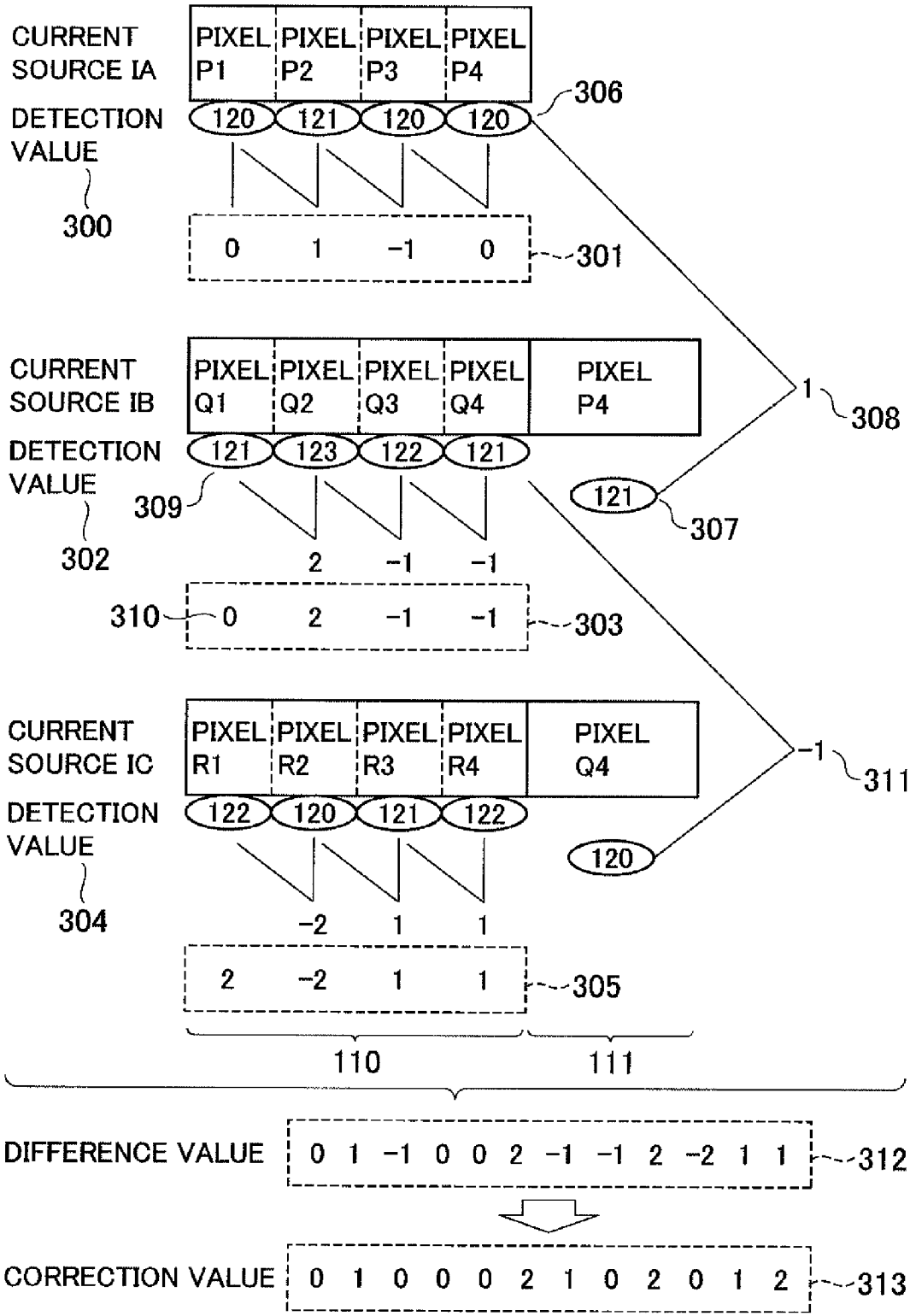
FIG. 9 is a diagram for explaining a detection calculation.

FIG. 9 is a diagram for explaining a detection calculation in a detection structure divided into blocks in the horizontal direction in FIG. 8. In the present embodiment, the number of pixels of each block is set to 4 pixels. In the detection period 110, pixels P1~P4 of the block A are detected with the current source IA, pixels Q1~Q4 of the block B are detected with the current source IB, and the pixels R1~R4 of the block C are detected with the current source IC. When the detection of the pixels is completed, in the detection period 111, the pixel P4 is detected with the current source IB and the pixel Q4 is detected with the current source IC. The detection result of the block A is a detection value 300, the detection result of the block B is a detection value 302, and the detection result of the block C is a detection value 304. In the present embodiment, the detection calculation unit 26 uses an amount of correction as a relative value using a difference value, as a method of calculating the correction value based on the detection result. Although it is also possible to use the absolute value based on the detection result, if the relative value is used, the amount of memory for storing the data can be reduced. A difference value 301 is a difference value between adjacent pixels in the block A. In other words, the pixel P1 which is the first pixel is set to "0", and a value "1" obtained by subtracting the detection value of the pixel P1 from the detection value of the pixel P2 is set as the difference value of the pixel P2. Similarly, the difference values are calculated for the pixels P3 and P4. A difference value 303 is a difference value between adjacent pixels in the block B. For pixels Q2, Q3, and Q4, the difference values of the adjacent pixels are used. For the pixel Q1, a difference value 308 calculated based on a detection value 306 detected with the current source IA and a detection value 307 detected with the current source IB is used for correcting the variation among the current sources. In other words, the difference value 308 is subtracted from the difference value between a detection value 309 and the detection value 306, and the result is set as a detection value 310. Similarly, a difference value 305 is a difference value between adjacent pixels in the block C. For the pixel R1, a difference value 311 calculated based on detections with current sources IB and IC is used for correction of the variation between the current sources. A difference value 312 is a value combining the difference values 301, 303, and 305. Based on the difference value 312, a value of previous pixel is cumulatively added, to calculate a correction value 313. The correction value is suppressed the variation among current sources in the horizontal direction, and the continuity in one line is maintained. In this manner, the variation of the detection results detected in parallel is corrected.

The explanation of the detection calculation described above also applies to the detection calculation for the second through fourth preferred embodiments to be described later. By calculating the correction value in a similar manner for the vertical direction in the third and fourth preferred embodiments, it is possible to maintain the continuity over the entire screen.

The present embodiment has been described in detail. An image display device of the present embodiment is, in general terms, an image display device having a unit which divides one line into a plurality of blocks, which has an A/D converter for detecting the pixel state for each block, and which detects in parallel. The image display device of the present embodiment further has a unit which detects, for at least one pixel in each block, the pixel state as the block and the pixel state as a block adjacent to the block and corrects variation between the detection result of the block and the detection result of the block adjacent to the block, based on the two detection results for the pixel. Moreover, the image display device comprises an independent current source in each block division, and a unit which detects, for at least one pixel in each block, with the ON and OFF states of the selection switch when the pixel state is detected as the block adjacent to the block. More specifically, the image display device comprises a unit which calculates a difference value of adjacent pixels which are the at least one pixel in the block positioned at an end of the block adjacent to the block, a unit which calculates a correction value based on the difference value, and a unit which calculates a difference in the pixel positioned at an end of the adjacent block using the detection result of the pixel of the end of each block as the adjacent block.

[Second Preferred Embodiment]

Figure 10:
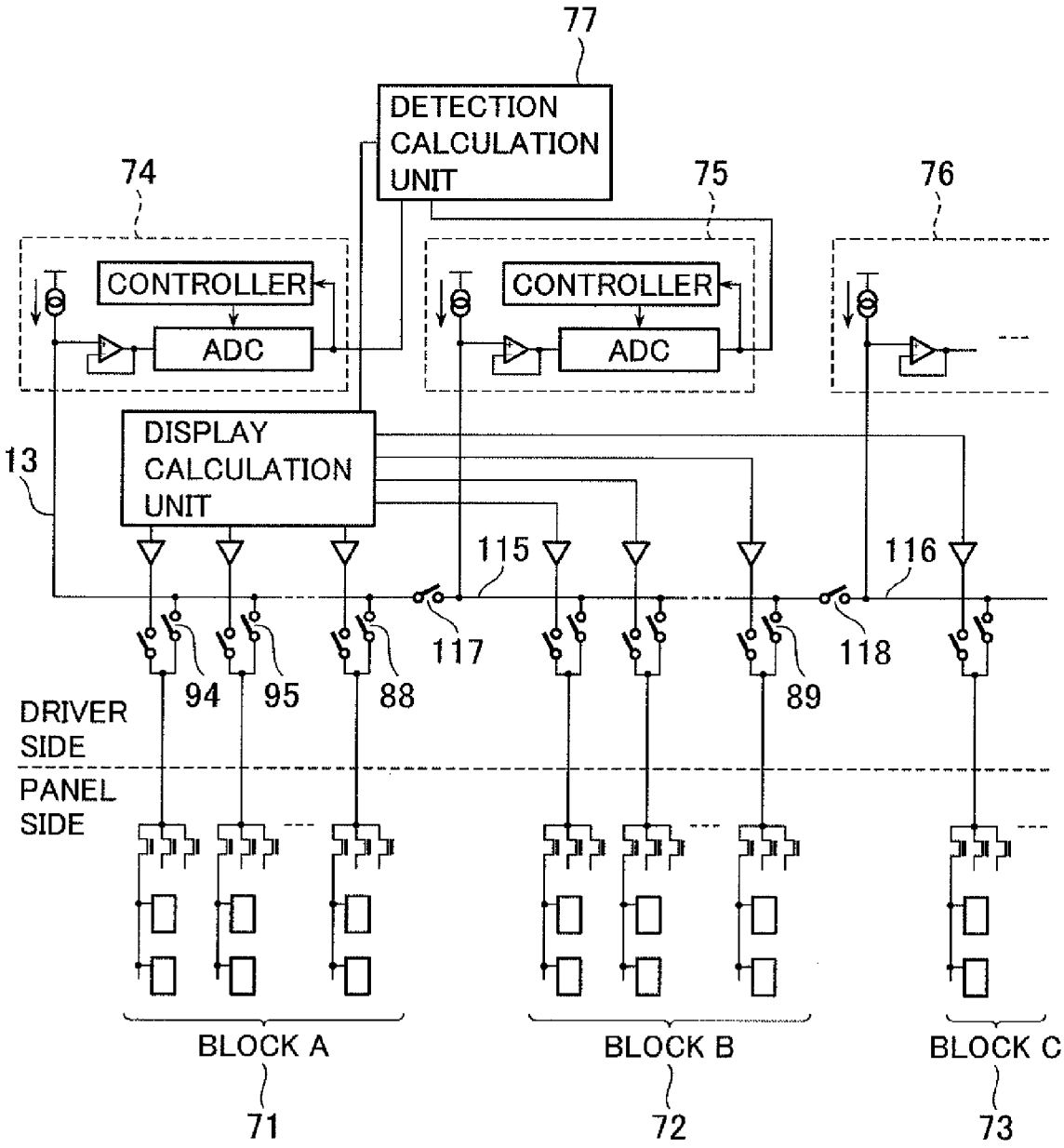
FIG. 10 is a diagram showing a structure of a second preferred embodiment of the present invention.

FIG. 10 shows an embodiment having a structure different from the structure of FIG. 7 showing the first preferred embodiment. In this structure, an example configuration is shown for a method of detecting by dividing the horizontal direction and detecting in parallel. A difference from FIG. 7 is that the blocks do not have a structure in which the current source is completely separated by the switch, but rather, have a structure in which the current is applied to the pixel in the block by switching the current source ON and OFF. In the present embodiment, a configuration is shown in which the horizontal direction is divided into a block A 71, a block B 72, and a block C 73. Each block comprises a conversion unit which has an independent current source and an A/D converter. The conversion unit of the block A 71 is a conversion unit 74, the conversion unit of the block B 72 is a conversion unit 75, and the conversion unit of the block C 73 is a conversion unit 76. A detection calculation unit 77 collectively controls the output from the conversion units. The detection calculation unit is not provided for each block, but rather, is provided for the entire structure. A detection line in the block A 71 is the detection line 13, a detection line in the block B 72 is a detection line 115, a detection line in the block C 73 is a detection line 116. The detection line 13 and the detection line 115 are connected by a switch 117, and the detection line 115 and the detection line 116 are connected by a switch 118. A last group of pixels of the block A 71 and the detection line 13 are connected by a switch 88, and a last group of pixels of the block B 72 and the detection line 115 are connected by a switch 89. A first group of pixels of the block A 71 and the detection line 13 are connected by a switch 94, and a second group of pixels of the block A 71 and the detection line 13 are connected by a switch 95. When the pixel of the block A 71 is detected with the current source of the block A, the switch 117 is switched OFF. When the pixel of the block A 71 is detected with the current source of the block B, the switch 117 is switched ON, the current source of the block A is switched OFF, and detection is executed with the conversion unit 75 of the block B.

Figure 11:
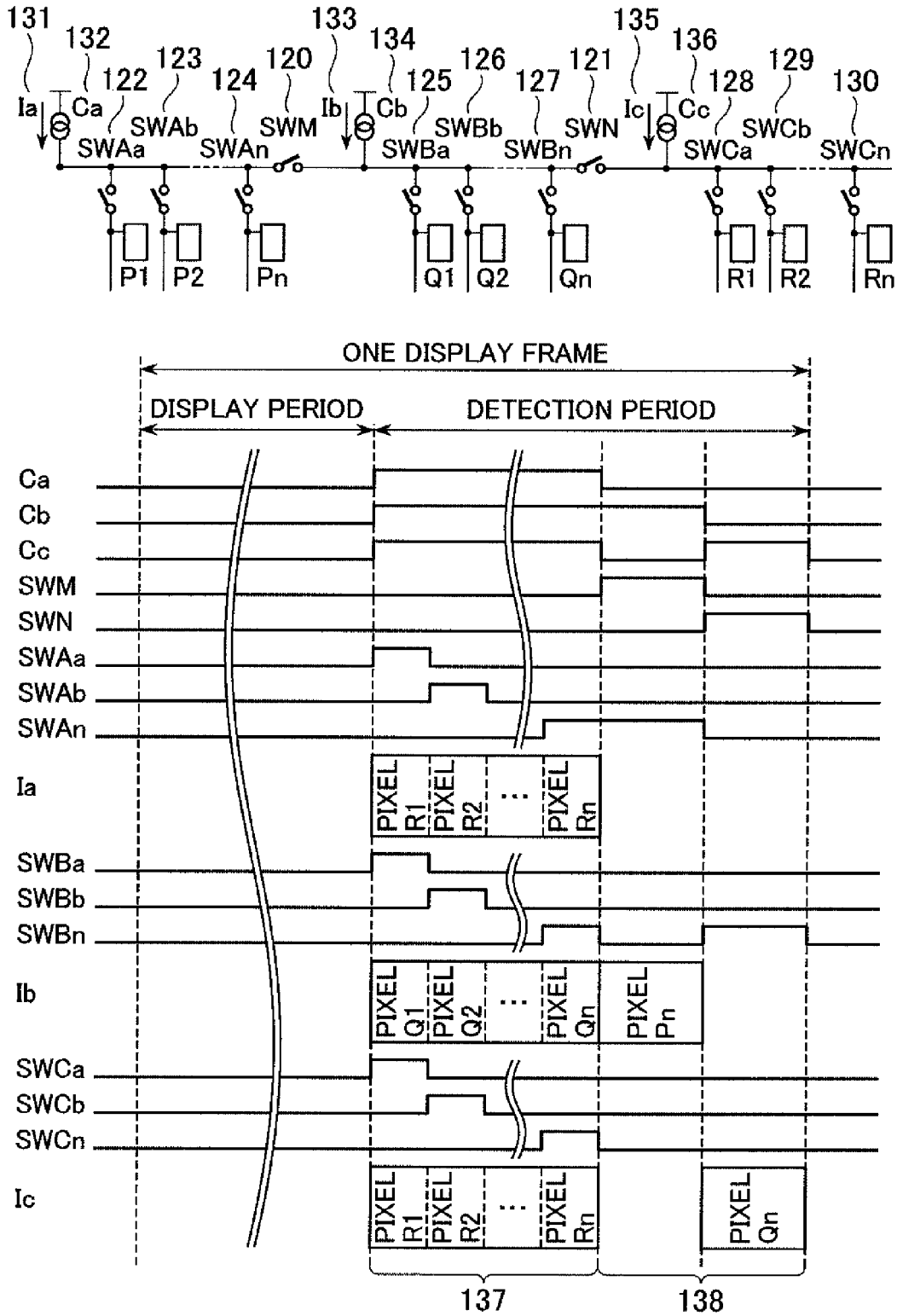
FIG. 11 is a diagram showing a timing in a second preferred embodiment of the present invention.

FIG. 11 is a diagram showing in a simplified manner the detection switch portion in the structure of FIG. 10, and shows the timings of the switches. As the timings of the switches on the detection line, the timing of the switch 117 is set as SWM 120 and the timing of the switch 118 is set as SWN 121. As the timings of the switches for controlling pixel, the timing of the control switch 94 of the first pixel of the block A 71 is set as SWAa 122, the timing of the control switch 95 of the second pixel is set as SWAb 123, and the timing of the control switch 88 of the last pixel of the block is set as SWAn 124. Similarly, the timing of the control switch of the first pixel of the block B 72 is set as SWBa 125, the timing of the control switch of the second pixel is set as SWBb 126, the timing of the control switch of the last pixel of the block is set as SWBn 127, the timing of the control switch of the first pixel of the block C 73 is set as SWCa 128, the timing of the control switch of the second pixel is set as SWCb 129, and the timing of the control switch of the last pixel of the block is set as SWCn 130. The current of the current source is set as Ia 131 for the block A, Ib 133 for the block B, and Ic 135 for the block C. The operation timings are set as Ca 132, Cb 134, and Cc 136. As the timings in one display frame, during the display period, all switches and all currents of all current sources are switched OFF. Although the detection period is divided into the detection setting, detection, and detection calculation, the detection setting and the detection calculation are not shown in FIG. 11, and only the timing of the detection is shown. The detection timing includes a detection period 137 of each pixel and a detection period 138 for correcting the current source. During the detection period 137, first, Ca 132, Cb 134, and Cc 136 are set to the ON state and the current sources are set, the pixels of the blocks, that is, a pixel P1 of the block A, a pixel Q1 of the block B, and a pixel R1 of the block C are simultaneously detected in parallel, and the detection is similarly executed until the last pixels of the blocks. During the detection period 138, in order to correct the detection result of current sources of a certain block and a block adjacent to the block, detection is executed with both current sources for the same pixel, and the detection value based on a second current source is corrected based on a reference at the detection value based on a first current source. With this process, the influence of the block division is suppressed, and the continuity of one line is maintained. During the detection period 137, while the SWM 120 and the SWN 121 are set in the OFF state, the SWAa 122, SWAb 123, SWAn 124, SWBa 125, SWBb 126, SWBn 127, SWCa 128, SWCb 129, and SWCn 130 are switched ON and OFF corresponding to the detection pixel. During this period, Ia 131 from the current source is used in the block A, Ib 133 from the current source is used in the block B, and Ic 135 from the current source is used in the block C. During the detection period 138, first, the SWAn 124 and SWM 120 are set in the ON state and the other switches are set in the OFF state, the current source Cb 134 is switched to the ON state, and the current sources Ca 132 and Cc 136 are switched to the OFF state. During this period, Ib 133 from the current source is used in the block A, and a pixel Pn which is the last pixel of the block is detected. Then, the SWBn 127 and SWN 121 are set to the ON state, the other switches are set to the OFF state, the current source Cc 136 is set to the ON state, and the current sources Ca 132 and Cb 134 are set to the OFF state. During this period, Ic 135 from the current source is used in the block B, and a pixel Qn which is the last pixel of the block is detected. Then, correction data for one line is calculated based on the detection values of the pixels detected in the detection period 137 and the detection period 138.

As described in detail in the above, the image display device according to the present embodiment is, in general terms, similar to the image display device of the first preferred embodiment, with a difference that an independent current source is provided in each block division and a unit is provided which detects with switching ON and OFF of the current sources during detection of the pixel state of at least one pixel of each block, as a block adjacent to the block.

[Third Preferred Embodiment]

Figure 12:
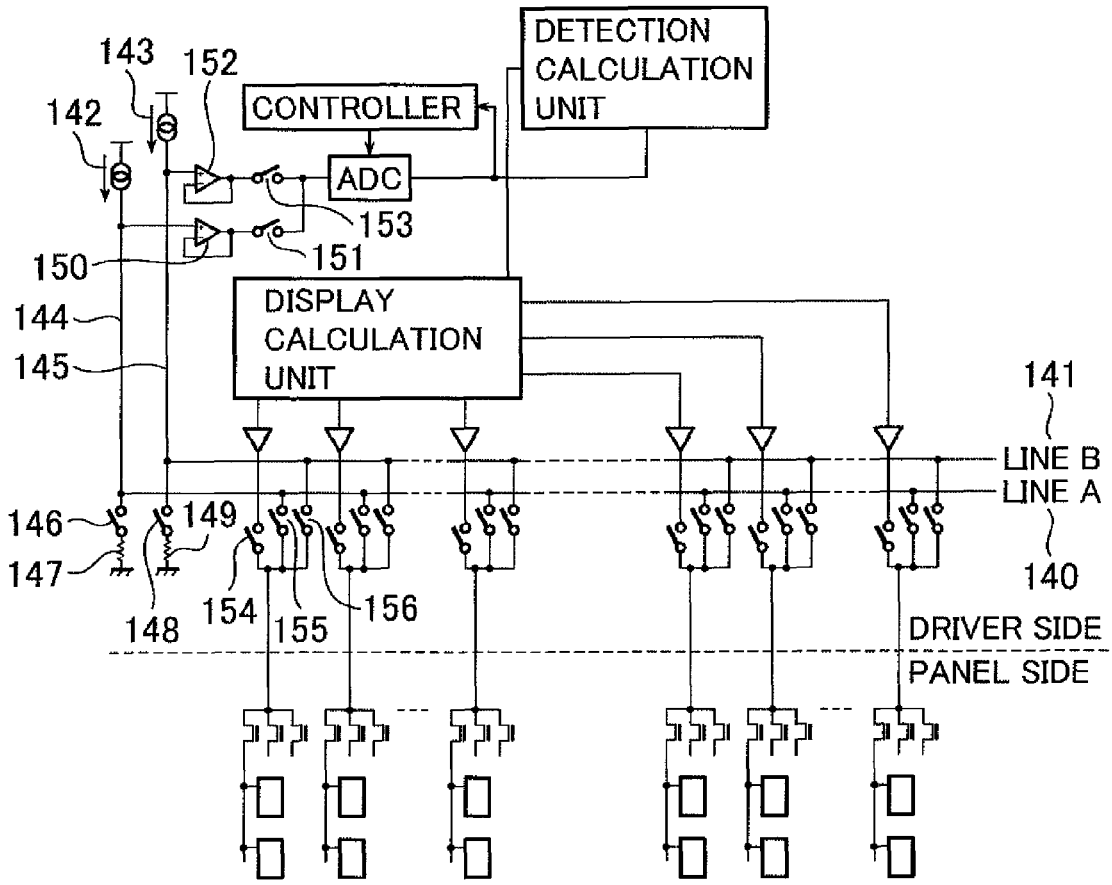
FIG. 12 is a diagram showing a structure of a third preferred embodiment of the present invention.

FIG. 12 shows a preferred embodiment which has a different structure from a structure of FIG. 7 showing the first preferred embodiment. In this structure, a configuration is exemplified in which the detection in the vertical direction is divided and detection is executed in parallel. In the present embodiment, no switch is provided in the detection line in the horizontal direction. Instead, the number of detection lines is increased in the vertical direction. In FIG. 12, a structure is shown in which two lines in the vertical direction are simultaneously detected. The conversion unit comprises two current sources and two buffers, but, for the A/D converter, one common A/D converter is used. On a line A 140, a current source 142 and a detection line 144 are provided, a switch 146 which switches a resistor 147 which is a dummy resistor is provided, and a buffer 150 for holding the detection result is provided. On a line B 141, a current source 143 and a detection line 145 are provided, a switch 148 which switches a resistor 149 which is a dummy resistor is provided, and a buffer 152 for holding the detection result is provided. The conversion unit comprises a switch 151 for selecting the buffer 150 and a switch 153 for selecting the buffer 152, and inputs in a time divisional manner to the A/D converter, and the correction data is calculated. As the switching switches in the signal lines connected to the pixels, a switch 154 for selecting a signal from the display calculation unit, a switch 155 for selecting a signal from the line A 140, and a switch 156 for selecting a signal from the line B are provided. The switches 154, 155, and 156 are not simultaneously switched ON, and are alternatively switched ON.

Figure 13:
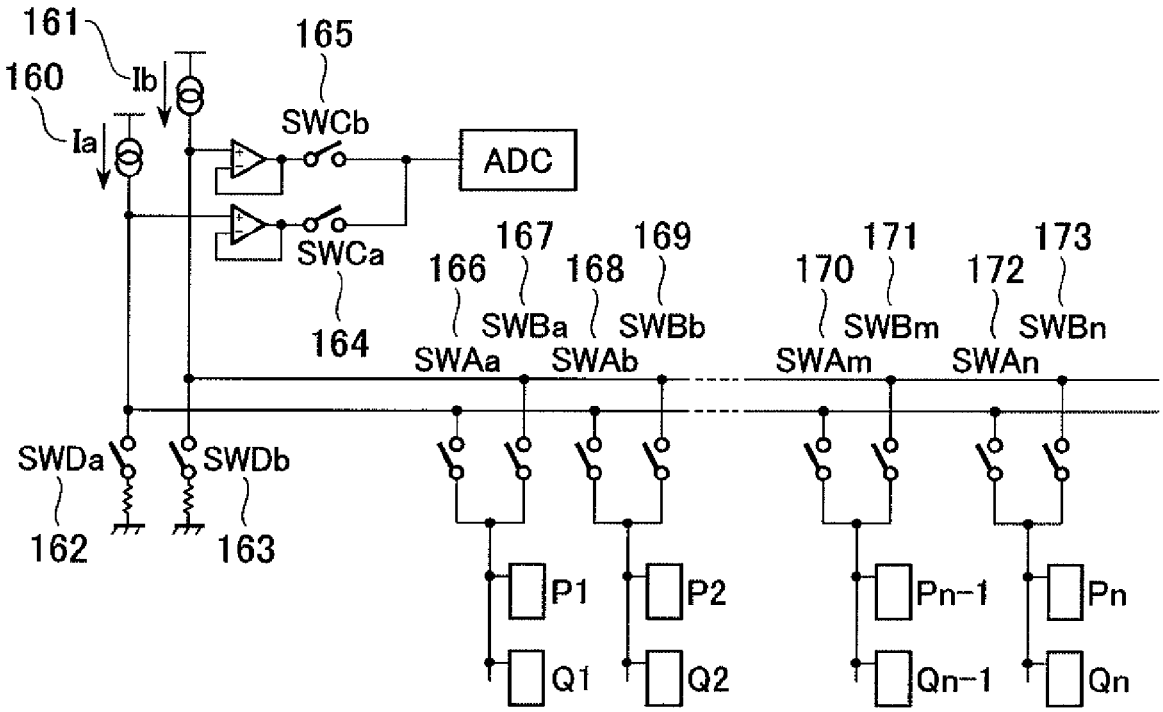
FIG. 13 is a diagram showing in a simplified manner a detection switch portion of a third preferred embodiment of the present invention.

FIG. 13 is a diagram showing a detection switch portion in the structure of FIG. 12 in a simplified manner, and shows control of the switches. As the current of the current source, the current from the current source 142 is set as Ia 160 and the current from the current source 143 is set as Ib 161. AS the timings of the switches on the detection line, the timing of the switch 146 is set as SWDa 162, and the timing of the switch 148 is set as SWDb 163. As the timings of the selection switch of the buffers, the timing of the switch 151 is set as SWCa 164 and the timing of the switch 152 is set as SWCb 165. As the timings of the connection switches between the pixels and the detection line, the timing of the connection switch between a first pixel and the line A 140 is set as SWAa 166, the timing of the connection switch between the first pixel and the line B 141 is set as SWBa 167, the timing of the connection switch between a second pixel and the line A 140 is set as SWAb 168, the timing of the connection switch between the second pixel and the line B 141 is set as SWBb 169, the timing of the connection switch between a second to last pixel and the line A 140 is set as SWAm 170, the timing of the connection switch between the second to last pixel and the line B 141 is set as SWBm 171, the timing of the connection switch between a last pixel and the line A 140 is set as SWAn 172, and the timing of the connection switch between the last pixel and the line B 141 is set as SWBn 173.

Figure 14:
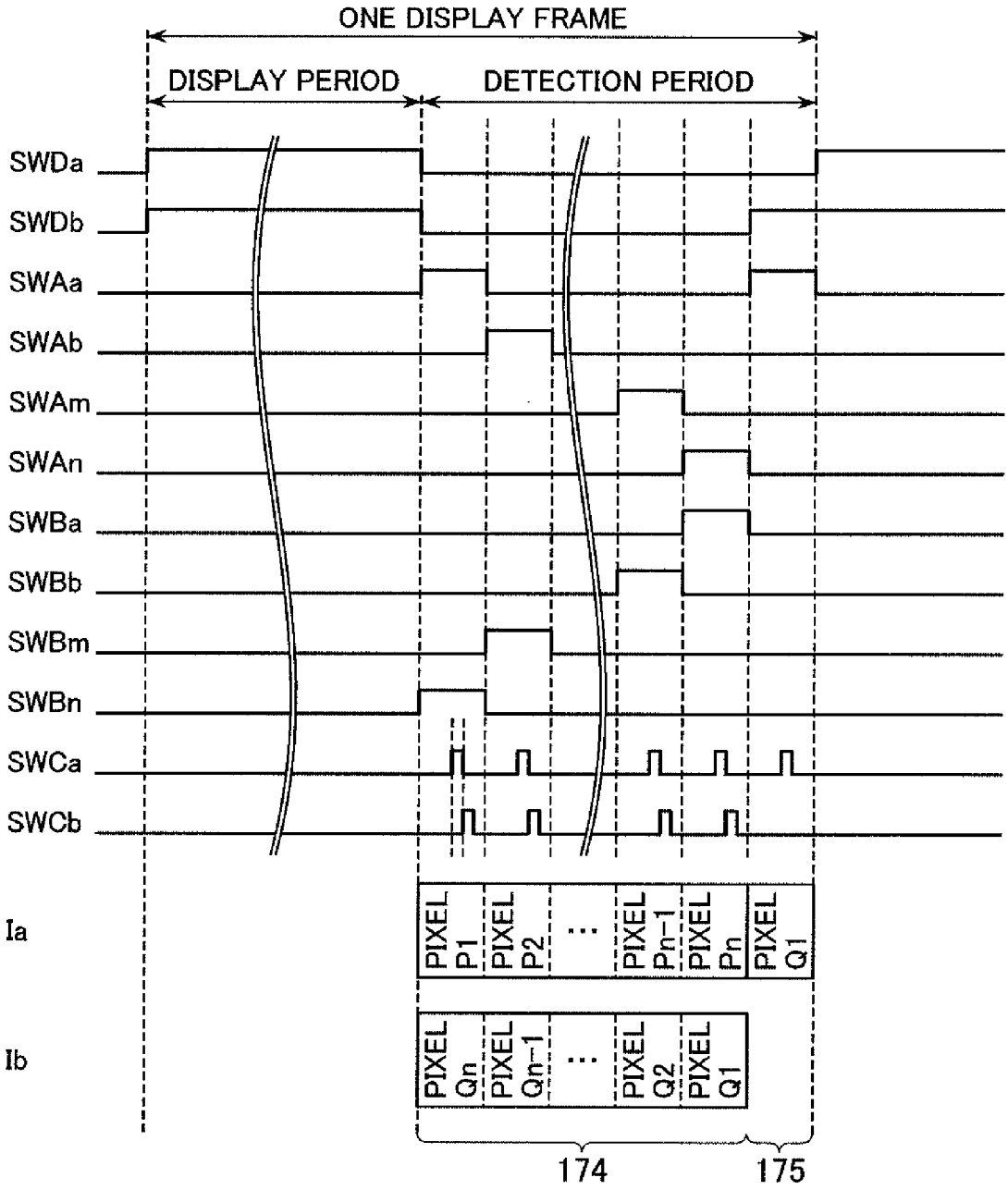
FIG. 14 is a diagram showing a timing in a third preferred embodiment of the present invention.

FIG. 14 shows timings of the switches of FIG. 13. As the timing in one display frame, during the display period, the switches of the SWDa 162 and the SWDb 163 are set to the ON state and the other switches are set to the OFF state. In this configuration, because a dummy resistor is provided, it is not necessary to stop the operation of the current source. Although the detection period is divided into detection setting, detection, and detection calculation, in FIG. 14, the detection setting and the detection calculation are not shown, and only the timing of the detection is shown. The timing of the detection includes a detection period 174 for each pixel and a detection period 175 for current source correction. During the detection period 174, pixels P1~Pn are detected in the line A and pixels Q1~Qn are detected in the line B. The detection timing are set so that the pixels P1 and Qn are simultaneously detected, then, the pixels P2 and Qm are simultaneously detected, and so on, and finally, the pixels Pn and Q1 are detected. During the detection period 174, SWDa 162 and SWDb 163 are set to the OFF state, SWAa 166, SWAb 168, SWAm 170, SWAm 172, SWBa 167, SWBb 169, SWBm 171, and SWBn 173 are switched between the ON and OFF states depending on the corresponding detecting pixel, and the SWCa 164 and SWCb 165 are sequentially switched in order to control the pixels in a time divisional manner. For example, when the pixels P1 and Qn are detected, the SWAa 166 and SWBn 172 are set to the ON state and the other switches are set to the OFF state. In the state where the detection result appears on the input side of the buffer, the SWCa 164 is first switched to the ON state for A/D conversion, and then, the SWCa 164 is switched to the OFF state and the SWCb 165 is switched to the ON state for A/D conversion. The SWCa 164 and SWCb 165 operate in a similar manner in the detection of all pixels. In a normal display device, the number of pixels on one row is an even number, and, thus, there is no problem with the above-described detection. When the number of pixels per row is an odd number, on the other hand, it is possible, for example, to detect the center pixel at a different timing. During the detection period 175, in order to correct the detection results of the current sources for the line A 140 and the line B 141, the detection is executed at the same pixel with both current sources, and the detection value based on a second current source is corrected with a reference at the detection value based on a first current source. With this process, the influence between lines is suppressed, and continuity in the vertical direction is maintained. During this period, the SWDb 163 and SWAa are set to the ON state and the other switches are set to the OFF state, and the pixel Q1 is detected using the current source Ia 160. Then, based on the detection values of the pixel detected in the detection period 174 and the detection period 175, correction data of two lines is calculated.

Figure 15:
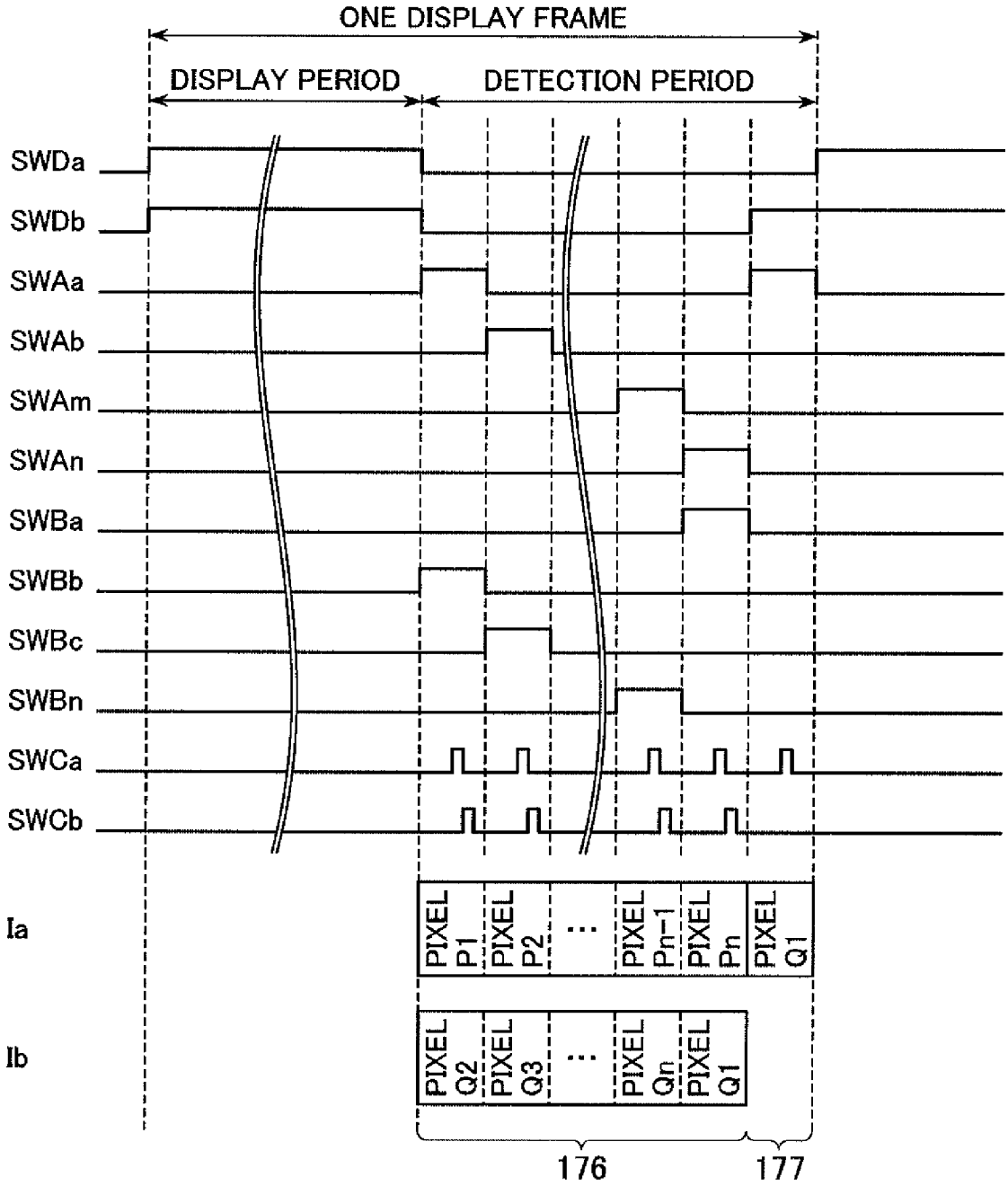
FIG. 15 is a diagram showing a timing in a third preferred embodiment of the present invention.

FIG. 15 shows another example timing of the switches of FIG. 13. A difference from FIG. 14 is in the order of the detection pixel. The timing of detection during the detection period includes a detection period 176 for each pixel and a detection period 177 for current source correction. Of these, the control timing of the detection period 177 is identical to that of the detection period 175. During the detection period 176, the detection timings are set such that the pixels P1 and Q2 are simultaneously detected, then, pixels P2 and Q3 are simultaneously detected, and so on, the second-to-last pixel Pn-1 and the pixel Qn are simultaneously detected, and, finally, pixels Pn and Q1 are simultaneously detected. As a result, the correction data of two lines is calculated based on the detection values of the pixel detected in the detection period 176 and the detection period 177.

Figure 16:
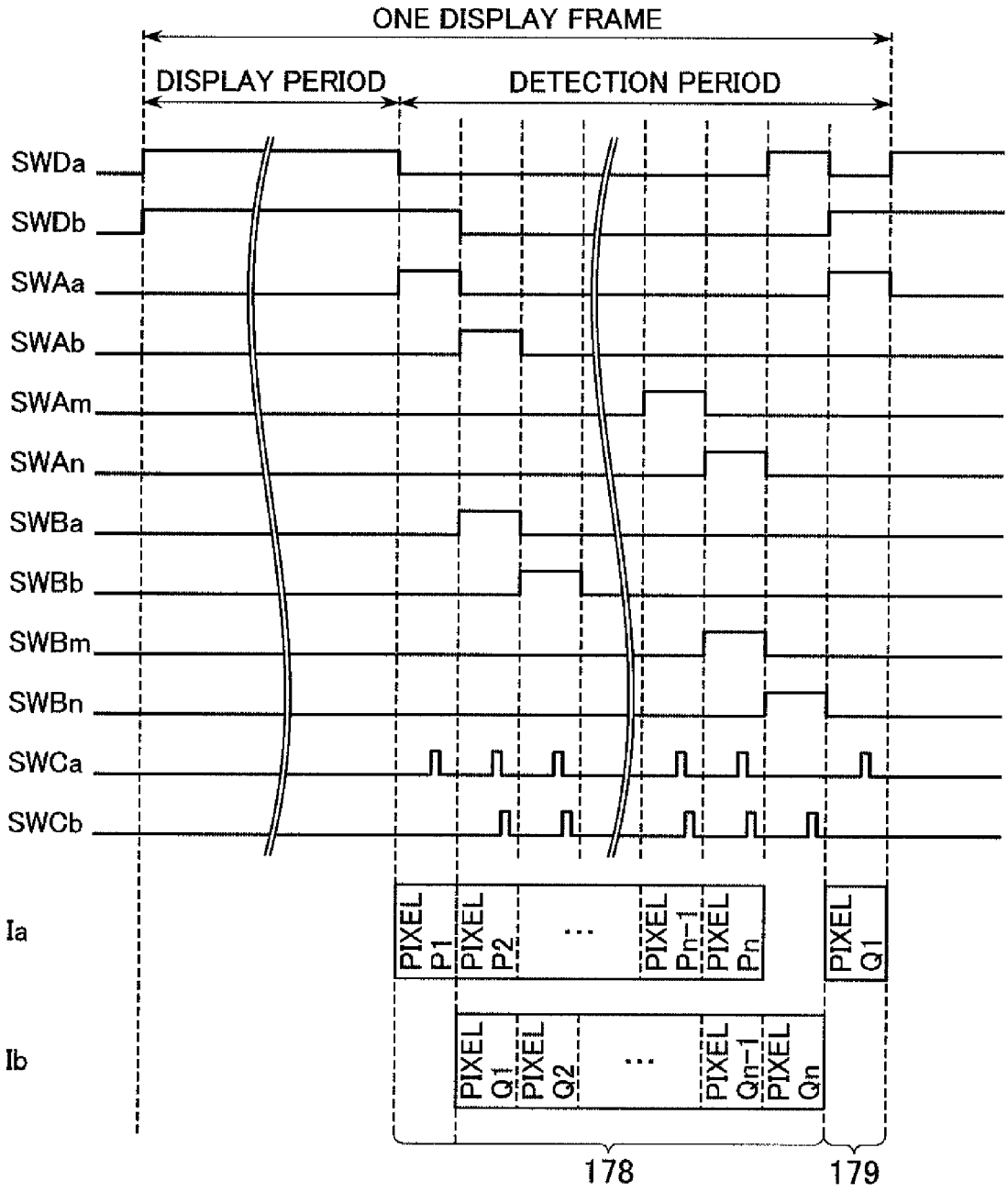
FIG. 16 is a diagram showing a timing in a third preferred embodiment of the present invention.

FIG. 16 shows another example timing of the switches of FIG. 13. A difference from FIGS. 14 and 15 is the order of detection pixels. The timing of detection in the detection period includes a detection period 178 for each pixel and a detection period 179 for current source correction. Of these, the control timing of the detection period 179 is identical to that of the detection period 175. During the detection period 178, the detection timings are set such that, first, the pixel P1 is detected as a single entity, then, pixels P2 and Q2 are simultaneously detected, and so on, the pixels Pn and Qn-1 are simultaneously detected, and, finally, the pixel Qn is detected as a single entity. According to this detection, the timings of the SWCa 164 and SWCb 165 are changed. As a result, correction data of two lines is calculated based on the detection values of the pixel detected in the detection period 178 and the detection period 179.

As is described in detail in the above, the image display device of the present embodiment is, in general terms, an image display device having a unit which has a conversion unit for collectively detecting a plurality of lines and which detects in parallel. In addition, the conversion unit comprises a plurality of buffers for holding the detection results of the lines, an A/D converter which processes the results in the buffers, and a unit which has a control unit which controls the buffer and the A/D converter and which detects in parallel. The image display device comprises a unit which detects, for at least one pixel in each line, a pixel state as the line and a pixel state as a line different from the line, and corrects the variation between the detection result of the line and the detection result of the line different from the line based on the two detection results for the pixel.

[Fourth Preferred Embodiment]

Figure 17:
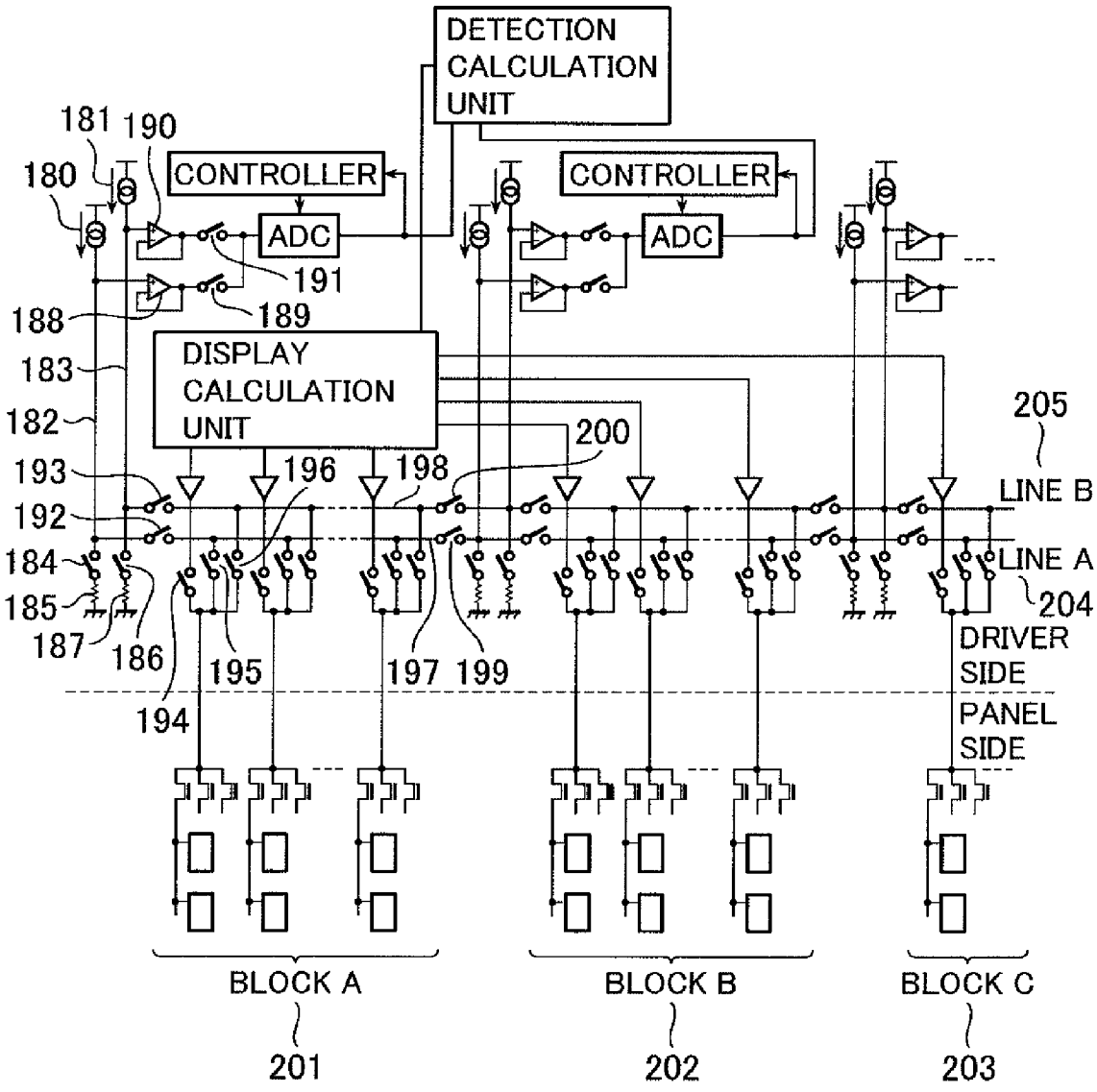
FIG. 17 is a diagram showing a structure of a fourth preferred embodiment of the present invention.

FIG. 17 shows a preferred embodiment having a structure different from the structure of FIG. 7 showing the first preferred embodiment. In this structure, an example method is shown for dividing each of the detections in the horizontal direction and vertical direction and detecting in parallel. In the present embodiment, for the detection line, the horizontal direction is divided into a block A 201, a block B 202, and a block C 203, and the vertical direction is divided to a line A 204 and a line B 205. The present embodiment has a structure in which the above-described horizontal detection and vertical direction are combined. Thus, although only block A is described with regard to the horizontal direction, the other blocks have similar structures. In the detection system of the line A 204, a current source 180 is connected to a detection line 182, a resistor 185 which is a dummy resistor in the block A 201 is connected to the detection line 182 by a switch 184, and a buffer 188 for holding the detection result is provided. In the detection system of the line B 205, a current source 181 is connected to a detection line 183, a resistor 187 which is a dummy resistor in the block A 201 is connected to the detection line 183 by a switch 186, and a buffer 190 for holding the detection result is provided. In a conversion unit, a switch 189 for selecting the buffer 188 and a switch 191 for selecting the buffer 190 are provided, and the data is inputted to the A/D converter in a time divisional manner and the correction data is calculated. With regard to the block A 201 and the current source, in the detection system of the line A 204, the detection line 182 and a detection line 197 are connected by a switch 192 and, in the detection system of the line B 205, the detection line 183 and a detection line 198 are connected by a switch 193. As switching switches on the signal lines connected to the pixel, a switch 194 which selects a signal from the display calculation unit, a switch 195 which selects a signal from the detection line 197, and a switch 196 which selects a signal from the detection line 198 are provided. These switches 194, 195, and 196 are not simultaneously switched ON, and are alternatively switched ON. In addition, as switches which connect the block A and the block B, a switch 199 is provided in the detection system of the line A and a switch 200 is provided in the detection system of the line B.

Figure 18:
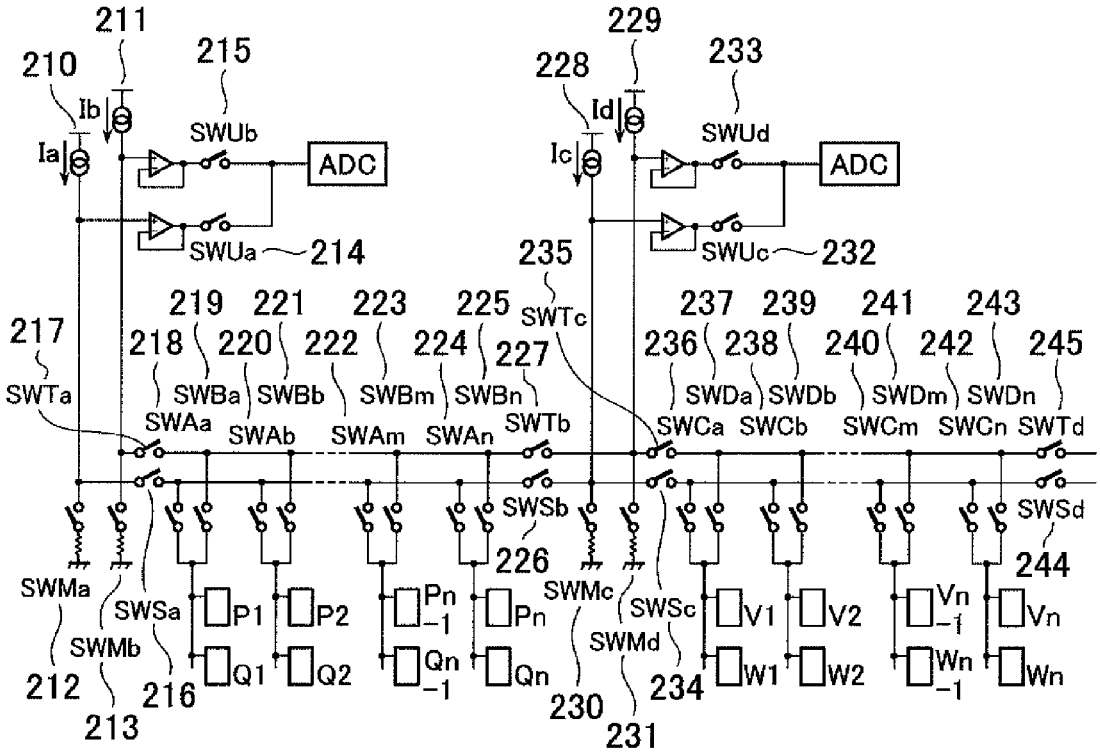
FIG. 18 is a diagram showing in a simplified manner a detection switch portion in a fourth preferred embodiment of the present invention.

FIG. 18 is a diagram showing the detection switch portion of the structure of FIG. 17 in a simplified manner, and shows control of the switches. As currents of the current sources, a current from the current source 180 is set as Ia 210 in the block A, a current from the current source 181 is set as Ib 211 in the block A, and currents of the current sources in the block B are similarly set as Ic 228 and Id 229. As the timings of selection switch of the buffers, in the block A, the timing of the switch 189 is set as SWUa 214, the timing of the switch 191 is set as SWUb 215, and timings in the block B are similarly set as SWUc 232 and SWUd 233. As the timings of the switches on the detection line, in the block A, the timing of the switch 184 is set as SWMa 212, the timing of the switch 186 is set as SWMb 213, the timing of the switch 192 is set as SWSa 216, the timing of the switch 193 is set as SWTa 217, the timing of the switch 199 is set as SWSb 226, the timing of the switch 200 is set as SWTb 227, and the timings are similarly set in the block B as SWMc 230, SWMd 231, SWSc 234, SWTc 235, SWSd 244, and SWTd 245. As the timings of the connection switches between the pixels and the detection lines, in the block A, the timing of the connection switch between a first pixel and the line A 204 is set as SWAa 218, the timing of the connection switch between the first pixel and the line B 205 is set as SWBa 219, the timing of the connection switch between a second pixel and the line A 204 is set as SWAb 220, the timing of the connection switch between the second pixel and the line B 205 is set as SWBb 221, the timing of the connection switch between a second to last pixel and the line A 204 is set as SWAm 222, the timing of the connection switch between the second to last pixel and the line B 205 is set as SWBm 223, the timing of the connection switch between a last pixel and the line A 204 is set as SWAn 224, and the timing of the connection switch between the last pixel and the line B 205 is set as SWBn 225. Similarly, in the block B, the timing are set as SWCa 236, SWDa 237, SWCb 238, SWDb 239, SWCc 240, SWDc 241, SWCd 242, and SWDd 243.

Figure 19:
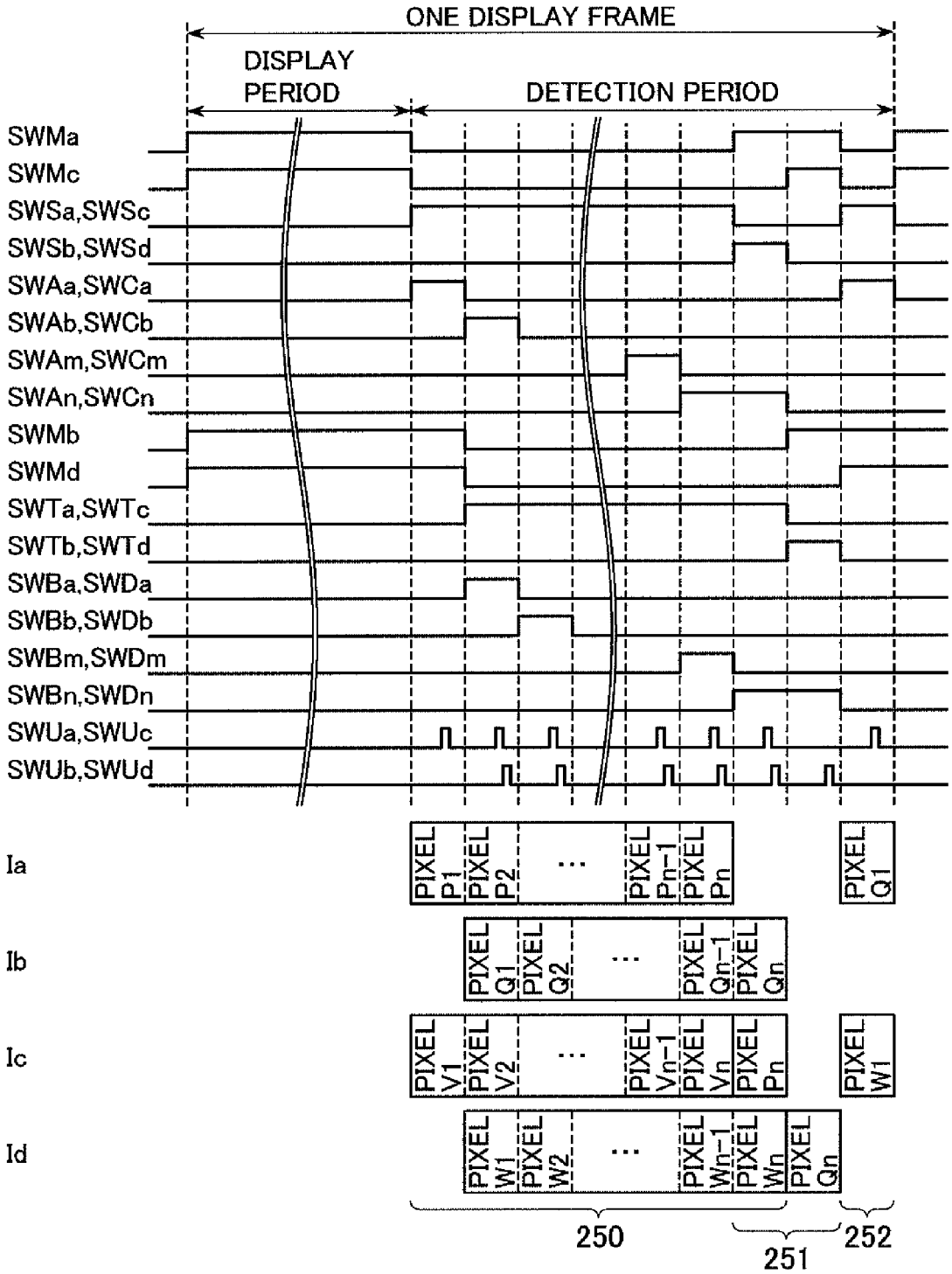
FIG. 19 is a diagram showing a timing in a fourth preferred embodiment of the present invention.

FIG. 19 shows timings of the switches of FIG. 18. As the timings in one display frame, during the display period, the switches of SWMa 212, SWMb 213, SWMc 214, and SWMd 215 are set to the ON state and the other switches are set to the OFF state. In the present structure, because a dummy resistor is provided, the operation of the current source does not need to be stopped. Although the detection period is divided to detection setting, detection, and detection calculation, in FIG. 19, the detection setting and the detection calculation are not shown, and only the timing of the detection is shown. The timing of the detection comprises a detection period 250 for each pixel, a detection period 251 for current source correction between blocks, and a detection period 252 for current source correction between lines. During the detection period 250, in the block A, the pixels P1~Pn are detected with the line A and pixels Q1~Qn are detected in the line B. In the block B, pixels V1~Vn are detected in the line A and pixels W1~Wn are detected in the line B. The detection timings are set such that, first, the pixels P1 and V1 are simultaneously detected, the pixels P2 and Q1 and pixels V2 and W1 are simultaneously detected next, and so on, and pixels Pn and Qn-1 and pixels Vn and Wn-1 are simultaneously detected, and, finally, the pixels Qn and Wn are detected. The timings of the switches are set so that the switches are switched ON and OFF to establish a path connecting the detection target pixel to the detection line. During the detection period 251, in order to correct the detection result of the current source between a certain block and an adjacent block, the detection is executed with both current sources for the same pixel, and the detection value based on a second current source is corrected with a reference at the detection value based on a first current source. With this process, the influence of the block division is suppressed and continuity in one line is maintained. For the pixel Pn, detection is executed with the current source Ia and the current source Ic, and, for pixel Qn, the detection is executed with the current source Ib and the current source Id. During the detection period 252, in order to correct the detection results of the current sources of the line A 204 and the line B 205, the detection is executed with both current sources for the same pixel, and the detection value based on a second current source is corrected with a reference at the detection value based on a first current source. With this process, the influence between lines is suppressed and the continuity in the vertical direction is maintained. For the pixel Q1, the detection is executed with the current source Ia and the current source Ib, and, for the pixel W1, the detection is executed with the current source Ic and the current source Id. Alternatively, other methods maybe employed as the correction method of the current sources in the detection period 251 and the detection period 252. Based on the detection values of the pixel detected in the detection period 250, detection period 251, and detection period 252, correction data for two lines is calculated.

As is described in detail, the image display device of the present embodiment is, in general terms, an image display device comprising a unit which divides one line into a plurality of blocks in the horizontal direction and detects in parallel and a unit which collectively detects in parallel a plurality of lines in the vertical direction, and a unit which simultaneously controls these units. The image display device further comprises an independent current source for each line in each block, a plurality of buffers, in the conversion unit in each block, for holding the detection result of the lines, an A/D converter for processing results of the buffers, a controlling circuit for controlling these units, and a unit which simultaneously controls these units. The image display device also comprises a unit which detects, for at least one pixel in each block, a pixel state as the block and a pixel state as a block adjacent to the block and corrects variation between detection result of the block and the detection result of the block adjacent to the block based on the two detection results for the pixel, and a unit which detects, for at least one pixel in each line, the pixel state as the line and the pixel state as a line different from the line and corrects the variation between the detection result of the line and the detection result of the line different from the line based on the two detection results for the pixel.

While there have been described what are at present considered to be certain embodiments of the invention, it will be understood that various modifications may be made thereto, and it is intended that the appended claims cover all such modifications as fall within the true spirit and scope of the invention

What is claimed is:

1. A image display device including a display section which includes a plurality of pixels, a first line for inputting a display signal to the pixels, and a second line for outputting pixel states of the pixels, the image display device comprising:

a parallel detection unit which divides the plurality of pixels in the display section into a plurality of groups and detects pixel states in parallel, the parallel detection unit including:

a first parallel detection unit which divides at least one third line, into a plurality of blocks in a horizontal direction and which detects pixel states of said pixels from said plurality of blocks in parallel, a second parallel detection unit which collectively detects pixel states of said pixels in parallel from a plurality of vertical lines in the display section, and a controller which controls the first and second parallel detection units in parallel.

2. The image display device according to claim 1, wherein a plurality of third lines are provided, further comprising:

current sources independent for each of said plurality of third lines and each of the plurality of blocks, and conversion units which detects pixel states of the pixels for each block, wherein the controller controls the conversion units, and wherein the conversion unit of each block includes:

a plurality of buffers each of which hold a detection result of each of the plurality of third lines, an A/D converter which processes the detection result in each of the buffers, and a control circuit which controls the buffer and the A/D converter.

3. The image display device according to claim 1, further comprising:

a first correcting unit which detects, for at least one pixel in each block, a pixel state of the block and a pixel state of an adjacent block, and corrects variation between the detection result of the block and the detection result of the adjacent block, based on the two detection results for the pixel, and a second correcting unit which detects, for at least one pixel in each of said plurality of third lines, a pixel state through one of the plurality of third lines and a pixel state through another one of said plurality of third lines, and corrects a variation between the detection result of said one of said plurality of third lines and a detection result of the another one of said plurality of third lines, based on the two detection results for the pixel.

* * * * *